US006356718B1

(12) United States Patent
Matsumoto

(10) Patent No.: US 6,356,718 B1
(45) Date of Patent: Mar. 12, 2002

(54) IMAGE FORMING APPARATUS FOR OUTPUTTING A COLOR IMAGE

(75) Inventor: Kazuo Matsumoto, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/665,175

(22) Filed: Sep. 19, 2000

(51) Int. Cl.[7] ..... G03G 15/01
(52) U.S. Cl. ..... 399/40; 399/299
(58) Field of Search ..... 399/232, 298, 399/299, 231, 223, 38, 39, 40

(56) References Cited

U.S. PATENT DOCUMENTS 4,615,607 A * 10/1986 Yanagawa et al. ..... 399/231
5,765,081 A * 6/1998 Bogaert et al. ..... 399/299
5,887,230 A * 3/1999 Sakamaki et al. ..... 399/167

FOREIGN PATENT DOCUMENTS

JP 8-129282 5/1996

* cited by examiner

*Primary Examiner*—Quana M. Grainger
(74) *Attorney, Agent, or Firm*—Foley & Lardner

(57) ABSTRACT

This invention is made to cause photosensitive drums 21Y, 21M, 21C, 21B to be rotated at a constant circumferential speed even if the diameter of the photosensitive drum 21B is larger than the diameters of the photosensitive drums 21Y, 21M, 21C. As a result, the defect that the service lives of the photosensitive drums and the belt are shortened and image distortion occurs can be avoided and the photosensitive drum for black can be made larger than the diameters of the photosensitive drums for the other colors.

10 Claims, 14 Drawing Sheets

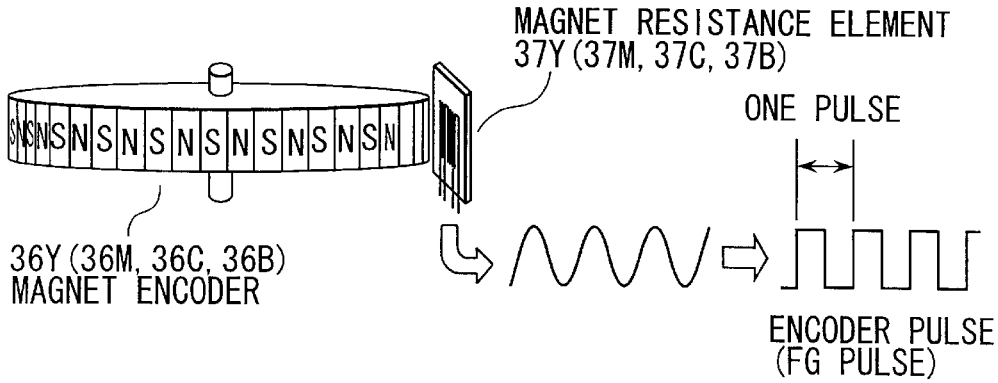
FIG. 3
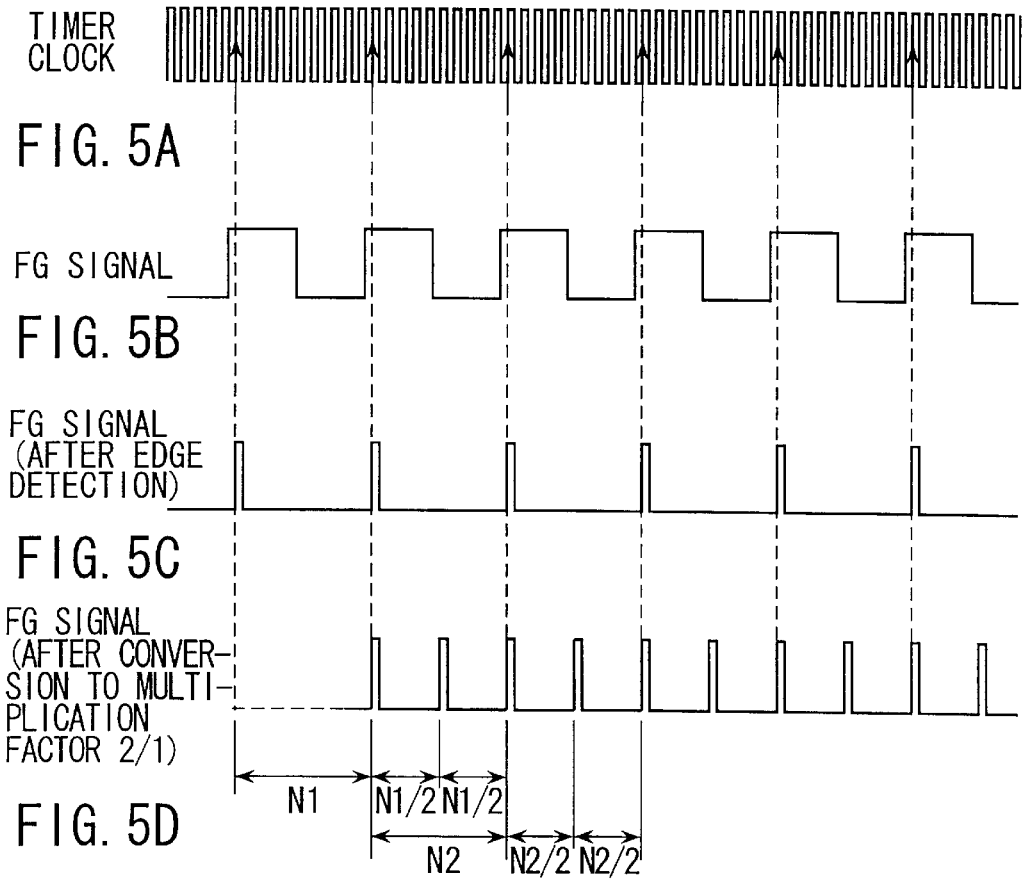

TIMER CLOCK

FG SIGNAL

FG SIGNAL (AFTER EDGE DETECTION)

FG SIGNAL (AFTER CONVERSION TO MULTIPLICATION FACTOR 2/1)

FORM FG SIGNAL AT INTERVAL OF TIMER CLOCK PULSES OBTAINED BY DIVIDING N1 BY 4
FORM FG SIGNAL AT INTERVAL OF TIMER CLOCK PULSES OBTAINED BY DIVIDING N2 BY 4
N1
N1/4
N1/4
N1/4
N1/4
N2
N2/4
N2/4
N2/4
N2/4
N3
N3/4
N3/4
N3/4
N3/4
N1: COUNT NUMBER OF TIMER CLOCK PULSES FOR THREE PULSES OF FG SIGNAL

IMAGE FORMING APPARATUS FOR OUTPUTTING A COLOR IMAGE

BACKGROUND OF THE INVENTION

This invention relates to an image forming apparatus such as a full-color copying machine or color printer.

Conventionally, as an image forming apparatus for outputting a color image, there is known a so-called 4-series tandem type full-color copying machine having four image forming units arranged side by side along the conveyer belt, for forming toner images of respective colors of yellow (Y), magenta (M), cyan (C) and black (B) based on color-separated image signals.

The image forming unit of each color has a photosensitive drum in rolling-contact with the conveyer belt, a charging device for charging the drum surface to a preset potential, an exposure device for exposing the drum surface to form an electrostatic latent image, a developing device for supplying toner to the electrostatic latent image on the drum surface to develop the same, and a transfer device for transferring the developed toner image on recording paper which is fed while being attracted to the conveyer belt. Then, the recording paper which is attracted to the conveyer belt is fed through the four image forming units, toner images of respective colors are transferred on the recording paper in a superposing manner, it is fed to the fixing device and the images of respective colors are fixed on the recording paper to form a color image.

In the above-described 4-series tandem type full-color copying machine using a DD motor (direct drive motor) for driving the photosensitive drum, the diameters of the four photosensitive drums are made equal to each other, a multi-pulse encoder is used to enhance the rotation precision, and angular speed settling control using the pulse signal is adopted.

On the other hand, the frequency of use of black among the four colors by the user in a monochrome mode is high. Therefore, for the high-speed operation of monochrome copying and long service life of the photosensitive drum, a method for increasing the diameter of the photosensitive drum for black is considered. In this case, since the diameters of the photosensitive drums are different, synchronization cannot be attained by using the conventional motor control with the angular speed kept constant as it is. The direct drive is given up and a method for changing the angular speed by use of gears can be provided, but in this case, it will be subject to a variation in rotation due to the precision of the gears.

Therefore, at present, even when the diameter of the photosensitive drum for black is made larger, the same encoder pulse number is used. For this reason, the circumferential speed of the photosensitive drum for black becomes higher in comparison with the other photosensitive drums and a difference in speed at the contact portions with the conveyer belt occurs. As a result, there occurs a defect that the service lives of the photosensitive drums and the belt are shortened and the image distortion occurs.

Further, in a case where the diameters of the respective photosensitive drums are the same, it is required to make fine adjustment and rotate the respective photosensitive drums at the constant circumferential speed.

BRIEF SUMMARY OF THE INVENTION

An object of this invention is to avoid a defect that the service lives of the photosensitive drums and the belt are shortened and the image distortion occurs, make it possible to increase the diameter of the photosensitive drum for black in comparison with the photosensitive drums for the other colors and attain the high-speed operation of the monochrome copying and the long service life of the photosensitive drum for black.

An object of this invention is to make it possible to finely adjust a small difference of the circumferential speed by changing the pulse of a reference clock so as to rotate the respective photosensitive drums at a constant circumferential speed in a case where the diameters of the respective photosensitive drums are the same.

An object of this invention is to make it possible to roughly adjust a small difference of the circumferential speed by changing an encoder pulse and finely adjust a difference between the peripheral speeds (circumferential speeds) caused by a variation in the diameters of the respective photosensitive drums by changing the pulse of a reference clock so as to rotate the respective photosensitive drums at a constant circumferential speed in a case where the diameters of the respective photosensitive drums are the same.

In order to attain the above object, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a larger diameter than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first control section for controlling rotation of the first rotating section at the rate of rotation based on the diameter of the first image carrying body; a second control section for controlling rotation of the second rotating section at the rate of rotation based on the diameter of the second image carrying body; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a larger diameter than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with n times (n=the diameter of the second image carrying body÷the diameter of the first image carrying body) the preset number of pulses for one revolution based on a second encoder provided on the rotating shaft of the second rotating section; a first control section for controlling rotation of the first rotating section at the rate of rotation based on the encode pulse from the first output section; a second control section for controlling rotation of the second rotating section at the rate of rotation based on the encode pulse from the second output section; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a larger diameter than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; converting means for converting an encode pulse from the second output section to a multiplied or frequency-divided pulse based on a difference between the diameters of the first and second image carrying bodies; a first control section for controlling rotation of the first rotating section at the rate of rotation based on the encode pulse from the first output section; a second control section for controlling rotation of the second rotating section at the rate of rotation based on the pulse from the converting means; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a larger diameter than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; a third output section for outputting a reference clock for rotating the first, second rotating sections at the preset rates of rotation; converting means for converting the reference clock from the third output section to a multiplied or frequency-divided pulse based on a difference between the diameters of the first and second image carrying bodies; a first control section for controlling rotation of the first rotating section at the rate of rotation based on the encode pulse from the first output section and the reference clock from the third output section; a second control section for controlling rotation of the second rotating section at the rate of rotation based on the encode pulse from the second output section and the pulse from the converting means; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having the same diameter as the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; a third output section for outputting a reference clock for rotating the first, second rotating sections at the preset rates of rotation; converting means for converting the reference clock from the third output section to a multiplied or frequency-divided pulse based on a difference between the circumferential speed of the first image carrying body and the circumferential speed of the second image carrying body; a first control section for controlling rotation of the first rotating section at the rate of rotation based on the encode pulse from the first output section and the reference clock from the third output section; a second control section for controlling rotation of the second rotating section at the rate of rotation based on the encode pulse from the second output section and the pulse from the converting means; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a diameter larger than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; a third output section for outputting a reference clock for rotating the first, second rotating sections at the preset rates of rotation; converting means for converting the reference clock from the third output section to a multiplied or frequency-divided pulse based on a difference between the circumferential speed of the first image carrying body and the circumferential speed of the second image carrying body; a first control section for controlling rotation of the first rotating section at the rate of rotation based on the encode pulse from the first output section and the reference clock from the third output section; a second control section for controlling rotation of the second rotating section at the rate of rotation based on the encode pulse from the second output section and the pulse from the converting means; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having a larger diameter than the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; first converting means for converting the encode pulse from the second output section to a multiplied or frequency-divided pulse based on a difference between the diameters of the first, second image carrying bodies; a third output section for outputting a reference clock for rotating the first, second rotating sections at the preset rates of rotation; second converting means for converting the reference clock from the third output section to a multiplied or frequency-divided pulse based on a difference between the circumferential speed of the first image carrying body and the circumferential speed of the second image carrying body; a first control section for controlling rotation of the first rotating section at the rate of rotation based on the encode pulse from the first output section and the reference clock from the third output section; a second control section for controlling rotation of the second rotating section at the rate of rotation based on the pulse from the first converting means and the pulse from the second converting means; and a fixing section provided along the feeding section in a succeeding stage of the second image forming unit, for fixing the toner image transferred on the recording medium; and characterized in that the circumferential speeds of the first, second image carrying bodies are made equal to each other.

Further, this invention provides an image forming apparatus comprising a feeding section for feeding a recording medium; a first image forming unit respectively including a first image carrying body provided along the feeding section and arranged in contact with the feeding section, a first latent image forming section for forming a latent image on the first image carrying body, a first developing section for supplying toner of first color to the latent image formed on the first image carrying body by the first latent image forming section to develop the same, and a first transfer section for transferring the toner image developed by the first developing section on the recording medium fed by the feeding section; a second image forming unit respectively including a second image carrying body having the same diameter as the first image carrying body, provided along the feeding section in a succeeding stage of the first image forming unit and arranged in contact with the feeding section, a second latent image forming section for forming a latent image on the second image carrying body, a second developing section for supplying toner of second color to the latent image formed on the second image carrying body by the second latent image forming section to develop the same, and a second transfer section for transferring the toner image developed by the second developing section on the recording medium fed by the feeding section; a first rotating section for rotating the first image carrying body; a second rotating section for rotating the second image carrying body; a first output section for outputting an encode pulse with a preset number of pulses for one revolution based on a first encoder provided on the rotating shaft of the first rotating section; a second output section for outputting an encode pulse with a preset number of pulses for one revolution based on a second encoder provided on the rotating shaft of the second rotating section; first converting means for converting the encode pulse from the second output section to a multiplied or frequency-divided pulse based on a difference between the circumferential speed of the first image carrying body and the circumferential speed of the second image carrying body; a third output section for outputting a reference clock for rotating the first, second rotating sections at the preset rates of rotation; second converting means for converting the reference clock from the third output section to a multiplied or frequency-divided pulse based on a variation in the peripheral speed of the first image carrying body; third converting means for converting the reference clock from the third output section to a multiplied or frequency-divided pulse based on a variation in the peripheral speed of the second image carrying body; a first control section for controlling rotation of the first rotating section at the rate of rotation based on the encode pulse from the first output section and the pulse from the second converting means; a second control section for controlling rotation of the second rotating section at the rate of rotation based on the pulse from the first converting means and the pulse from the third converting means; and a fixing section provided along the feeding section in a succeeding stage of the second image forming unit, for fixing the toner image transferred on the recording medium; and characterized in that the circumferential speeds of the first, second image carrying bodies are made equal to each other.

BRIEF DESCRIPTION OF SEVERAL VIEWS OF THE DRAWING

FIG. 3 is a view showing a magnet encoder mounted on a DC motor and a magnetic resistance element for outputting an FG pulse based on the magnet encoder;

FIGS. 5A to 5D are timing charts for illustrating an FG signal multiplying circuit;

DETAILED DESCRIPTION OF THE INVENTION

There will now be described an image forming apparatus according to an embodiment of this invention with reference to the drawings.

First Embodiment

Figure 1:
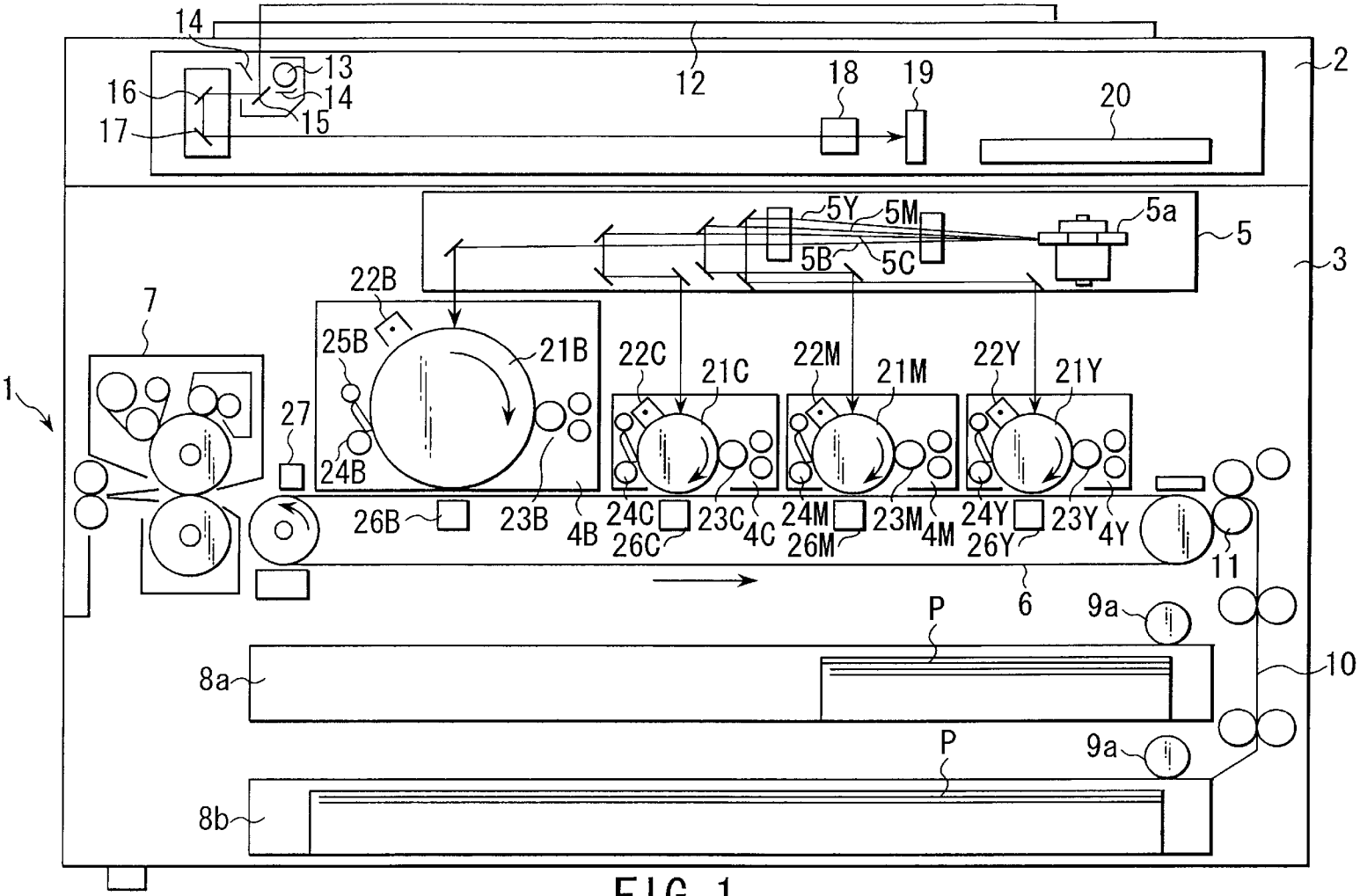
FIG. 1 is a schematic view for illustrating one example of a color image forming apparatus.

FIG. 1 is a schematic view for illustrating a color digital copying apparatus 1 which is one example of a color image forming apparatus of this invention.

As shown in FIG. 1, the color digital copying apparatus 1 is constructed by a scanner 2 for reading image information of a to-be-copied object which is not shown in the drawing as light and darkness of light to form an image signal, and an image forming apparatus 3 for forming an image corresponding to an image signal supplied from the scanner 2 or the exterior.

The scanner 2 includes an illumination lamp 13 for illuminating an original (not shown) placed on an original placing table 12, a reflector 14 for converging light from the illuminating lamp 13 towards the original, an optical system 20 for guiding light reflected from the original to a light receiving element 19 by use of reflection mirrors 15, 16, 17, image forming lens 18 and the like, the light receiving element 19 such as a CCD or the like for converting the light from the original to an electrical signal, and an image processing device 20 for subjecting the photoelectrically converted electrical signal to color separation to form image signals of respective colors of yellow (Y), magenta (M), cyan (C), black (B).

The image forming apparatus 3 includes four image forming sections 4Y, 4M, 4C and 4B for forming images of four colors of Y (yellow), M (magenta) and C (cyan) of three colors which are respective color components of subtractive primaries and B (black) for strengthening light and darkness, an exposure device 5 for applying exposure light, for example, laser beam whose light intensity is intermittently changed according to an image signal supplied from the scanner 2 or the exterior to photosensitive drums 21Y, 21M, 21C, 21B provided in the image forming sections 4Y, 4M, 4C and 4B, a transfer belt 6 for sequentially superposing images formed in the respective image forming sections 4Y, 4M, 4C and 4B on paper P while feeding the paper P which is a to-be-transferred material (image-to-be-formed medium), and a fixing device 7 for fixing a developer image on the paper P by applying pressure to the paper P fed by the transfer belt 6 and an image (developer image) on the paper P while heating them.

The image forming sections 4Y, 4M, 4C and 4B have substantially the same construction and form images corresponding to the respective colors by a known electrophotographic process. However, the diameters of the photosensitive drums 21Y, 21M, 21C are the same and the diameter of the photosensitive drum 21B is set to twice the diameters of the other photosensitive drums 21Y, 21M, 21C.

Around the photosensitive drums 21Y, 21M, 21C, 21B, charging devices 22Y, 22M, 22C, 22B, developing devices 23Y, 23M, 23C, 23B for accommodating developing powder (toner) of corresponding colors, transfer devices 26Y, 26M, 26C, 26B, cleaning devices 24Y, 24M, 24C, 24B, and discharging devices 25Y, 25M, 25C, 25B are respectively arranged in the rotating directions thereof to form color images corresponding to laser beams 5Y, 5M, 5C, 5B emitted from the exposure device 5 according to image signals separated for respective colors and scanned by a polygon mirror 5*a*.

The transfer devices 26Y, 26M, 26C, 26B are arranged in opposite positions below the photosensitive drums 21Y, 21M, 21C, 21B with the transfer belt 6 disposed therebetween.

Paper cassettes 8*a*, 8*b* for holding paper P on which toner images formed in the respective image forming sections 4Y, 4M, 4C and 4B are to be transferred are provided in a preset position below the transfer belt 6. Further, pickup rollers 9*a*, 9*b* for taking out paper P received in the cassettes one by one are provided for the respective paper cassettes 8*a*, 8*b*. Further, between the respective paper cassettes 8*a*, 8*b* and the transfer belt 6, a paper feeding section 10 constructed by guides and rollers for feeding the paper P taken out by the pickup roller 9*a*, 9*b* towards the transfer belt 6 is formed. In addition, in a preset position of the paper feeding section 10 on the transfer belt 6 side, an aligning roller 11 for setting the timing for feeding the paper P towards the transfer belt 6 in order to align the positions of the paper P which is taken out from either one of the cassettes and fed through the paper feeding section 10 and images formed in the respective image forming sections 4Y, 4M, 4C and 4B is provided.

In the color image forming apparatus 1 shown in FIG. 1, if an image signal is supplied from the scanner 2 or an external device, the photosensitive drums 21Y, 21M, 21C, 21B of the respective image forming sections 4Y, 4M, 4C and 4B are charged to preset potentials according to the time series by a charging power supply device which is not shown in the drawing and the laser beam whose light intensity is intermittently changed based on the image signal is applied from the exposure device 5 to the individual photosensitive drums 21Y, 21M, 21C, 21B.

As a result, electrostatic latent images corresponding to a color image to be output are formed on the photosensitive drums 21Y, 21M, 21C, 21B of the four image forming sections 4Y, 4M, 4C and 4B. In this case, timings at which the images are exposed on the photosensitive drums 21Y, 21M, 21C, 21B of the four image forming sections 4Y, 4M, 4C and 4B are defined in a preset order in accordance with the movement of the paper P fed on the transfer belt 6.

The electrostatic latent images formed on the photosensitive drums 21Y, 21M, 21C, 21B of the respective image forming sections 4Y, 4M, 4C and 4B are selectively supplied with toner and developed by the developing devices 23Y, 23M, 23C, 23B which are arranged in the same image forming sections 4Y, 4M, 4C and 4B and receive toner (developing powder) of predetermined colors and sequentially transferred on the paper P on the transfer belt 6 by the transfer devices which are disposed to face the photosensitive drums 21Y, 21M, 21C, 21B with the transfer belt 6 disposed therebetween. In this case, the paper P is taken out from the cassette which receives the paper P of a previously selected size or a size corresponding to the size of an image to be exposed by the exposure device 5, fed to the aligning roller 11 of the paper feeding section 10 and temporarily stopped at the aligning roller 11. Further, the paper P is fed from the aligning roller 11 towards the transfer belt 6 at the exposure timing of the image of the first color by the exposure device 5 or at a preset timing. At this time, the paper P is charged by a charging device (for the paper P) provided near the roller on the paper feeding section side which supports the transfer belt 6 and closely attached to the transfer belt 6.

The paper P on which toner or tone images formed by the respective image forming sections 4Y, 4M, 4C and 4B are transferred is fed to the fixing device 7 and toner melted in the fixing device 7 is fixed.

Figure 2:
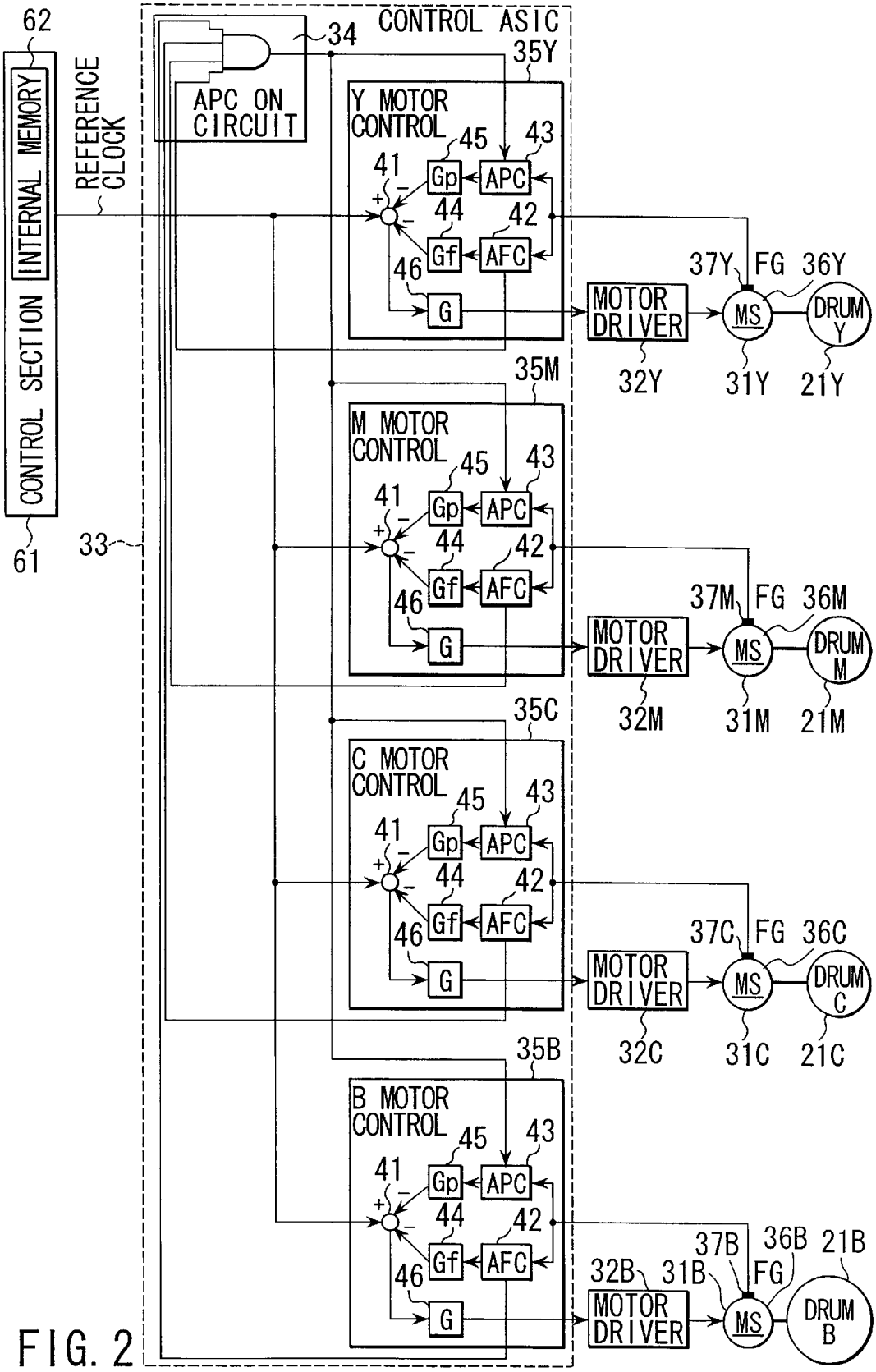
FIG. 2 is a diagram showing the schematic construction of a motor control section.

A motor control section 30 for controlling rotation of the photosensitive drums 21Y, 21M, 21C, 21B is explained with reference to FIG. 2.

The motor control section 30 is constructed by motor drivers 32Y, 32M, 32C, 32B for driving DC motors 31Y, 31M, 31C, 31B which respectively rotate the photosensitive drums 21Y, 21M, 21C, 21B and a control circuit 33. The control circuit 33 is constructed by a control ASIC and constructed by an APC ON circuit 34 and motor control circuits 35Y, 35M, 35C, 35B.

The photosensitive drums 21Y, 21M, 21C, 21B are respectively linked with the DC motors 31Y, 31M, 31C, 31B for rotation driving via belts or the like (not shown). The DC motors 31Y, 31M, 31C, 31B are respectively driven by different motor control circuits 35Y, 35M, 35C, 35B.

On the rotating shafts of the DC motors 31Y, 31M, 31C, 31B, magnet encoders 36Y, 36M, 36C, 36B as shown in FIG. 3 are respectively provided and FG pulses are respectively output as encoder pulses from magnetic resistance elements 37Y, 37M, 37C, 37B provided adjacent to the magnet encoders 36Y, 36M, 36C, 36B.

At this time, FG pulses of 600 pulses are output from the magnet encoders 36Y, 36M, 36C while the respectively corresponding photosensitive drums 21Y, 21M, 21C make one revolution.

Further, from the magnet encoder 36B, an FG pulse of 1200 pulses is output while the respectively corresponding photosensitive drum 21B makes one revolution.

As a result, since the diameter of the photosensitive drum 21B is twice different from the diameters of the photosensitive drums 21Y, 21M, 21C and the FG pulse number for one revolution is twice different, the DC motors 31Y, 31M, 31C, 31B are rotated and controlled at the same circumferential speed in the motor control circuits 35Y, 35M, 35C, 35B and the photosensitive drums 21Y, 21M, 21C, 21B are rotated at the same circumferential speed.

The motor control circuits 35Y, 35M, 35C, 35B are each constructed by an adder/subtracter 41, speed control section (AFC) 42, phase control section (APC) 43, amplifiers 44, 45, 46.

The motor control circuits 35Y, 35M, 35C, 35B are each supplied with a reference clock formed by loading an angular speed target setting value into a register of a control section (CPU) 61 for controlling the whole portion of the color digital copying apparatus 1 and are respectively supplied with FG pulses as encoder pulses from the magnetic resistance elements 37Y, 37M, 37C, 37B. Further, the motor control circuits 35Y, 35M, 35C, 35B are each supplied with an APC ON signal from the APC ON circuit 34.

Lock signals are output from the motor control circuits 35Y, 35M, 35C, 35B when the speeds by the speed control sections (AFC) 42 come into a certain range (±0.125% of the angular speed target setting value) with respect to the angular speed target setting value.

The motor control circuits 35Y, 35M, 35C, 35B output signals for accelerating or decelerating the DC motors 31Y, 31M, 31C, 31B by use of the respective speed control sections (AFC) 42 to the motor drivers 32Y, 32M, 32C, 32B to set the frequencies of the FG pulses as the encoder pulses from the magnetic resistance elements 37Y, 37M, 37C, 37B equal to the reference clock frequency from the control section 61 at the power supply turn-ON time (at the motor starting time).

The speed control sections (AFC) 42 of the motor control circuits 35Y, 35M, 35C, 35B respectively output signals for accelerating or decelerating the DC motors 31Y, 31M, 31C, 31B to the motor drivers 32Y, 32M, 32C, 32B to set the frequencies of the FG pulses as the encoder pulses from the magnetic resistance elements 37Y, 37M, 37C, 37B equal to the reference clock frequency from the control section 61.

The phase control sections (APC) 43 of the motor control circuits 35Y, 35M, 35C, 35B respectively effect the control operations to make the phase of one pulse of the frequencies of the FG pulses as the encoder pulses from the magnetic resistance elements 37Y, 37M, 37C, 37B coincident with the reference clock frequency from the control section 61 when the APC ON signal from the APC ON circuit 34 is supplied thereto.

The APC ON circuit 34 is constructed by an AND circuit and outputs the APC ON signal to the respective phase control sections (APC) 43 of the motor control circuits 35Y, 35M, 35C, 35B when the lock signals from the respective speed control sections (AFC) 42 of the motor control circuits 35Y, 35M, 35C, 35B are supplied thereto.

Next, with the above construction, the operation is explained.

In this case, the diameter of the photosensitive drum 21B is twice the diameters of the other photosensitive drums 21Y, 21M, 21C, FG pulses of 600 pulses are output from the magnet encoders 36Y, 36M, 36C corresponding to the DC motors 31Y, 31M, 31C while the corresponding photosensitive drums 21Y, 21M, 21C make one revolution, and an FG pulse of 1200 pulses is output from the magnet encoder 36B corresponding to the DC motor 31B while the corresponding photosensitive drum 21B makes one revolution.

That is, at the motor starting time such as the power supply turn-ON time or the like, the motor control circuits 35Y, 35M, 35C, 35B output signals for accelerating or decelerating the DC motors 31Y, 31M, 31C, 31B by use of the respective speed control sections (AFC) 42 to the motor drivers 32Y, 32M, 32C, 32B to set the frequencies of the FG pulses as the encoder pulses from the magnetic resistance elements 37Y, 37M, 37C, 37B equal to the reference clock frequency from the control section 61 at the power supply turn-ON time (at the motor starting time). As a result, they are set closer to the angular speed target setting value by accelerating or decelerating the DC motors 31Y, 31M, 31C, 31B.

Then, in the respective motor control circuits 35Y, 35M, 35C, 35B, the respective speed control sections (AFC) 42 output lock signals to the APC ON circuit 34 when the speeds by the speed control sections (AFC) 42 come into a certain range (±0.125% of the angular speed target setting value) with respect to the angular speed target setting value.

As a result, the APC ON circuit 34 outputs an APC ON signal to the respective phase control sections (APC) 43 of the motor control circuits 35Y, 35M, 35C, 35B when the lock signals from the respective speed control sections (AFC) 42 of the motor control circuits 35Y, 35M, 35C, 35B are supplied thereto.

Thus, the respective phase control sections (APC) 43 of the motor control circuits 35Y, 35M, 35C, 35B effect the control operations to make the phase of one pulse of the frequency of the FG pulses as the encoder pulses coincident with the frequency of the reference clock.

Therefore, even when the diameter of the photosensitive drum 21B is larger than the diameters of the other photosensitive drums 21Y, 21M, 21C, the photosensitive drums 21Y, 21M, 21C, 21B can be rotated at the constant circumferential speed.

That is, it is possible to avoid the defect that the service lives of the photosensitive drums and transfer belt are shortened and image distortion occurs and the photosensitive drum 21B for black can be made larger than the diameters of the photosensitive drums 21Y, 21M, 21C for the other colors.

Second Embodiment

The first embodiment illustrates a case wherein the photosensitive drums 21B, 21Y, 21M, 21C are rotated at the constant circumferential speed by making the FG pulse as the encoder pulses output from the magnetic resistance element 37B of the DC motor 31B different from the FG pulses as the encoder pulses output from the magnetic resistance elements 37Y, 37M, 37C of the DC motor 31Y, 31M, 31C according to the ratio of the diameter of the photosensitive drum 21B to the diameters of the other photosensitive drums 21Y, 21M, 21C, but this is not limitative and as the second embodiment, it can be realized in the same manner by setting equal the FG pulses as the encoder pulses output from the magnetic resistance elements 37Y, 37M, 37C, 37B of the DC motor 31Y, 31M, 31C, 31B and multiplying or frequency-dividing the FG pulse supplied to the motor control circuit 35B for controlling rotation of the DC motor 31B according to the ratio of the diameter of the photosensitive drum 21B to the diameters of the other photosensitive drums 21Y, 21M, 21C. The same portions as in the first embodiment are denoted by the same reference symbols and the explanation therefor is omitted.

Figure 4:
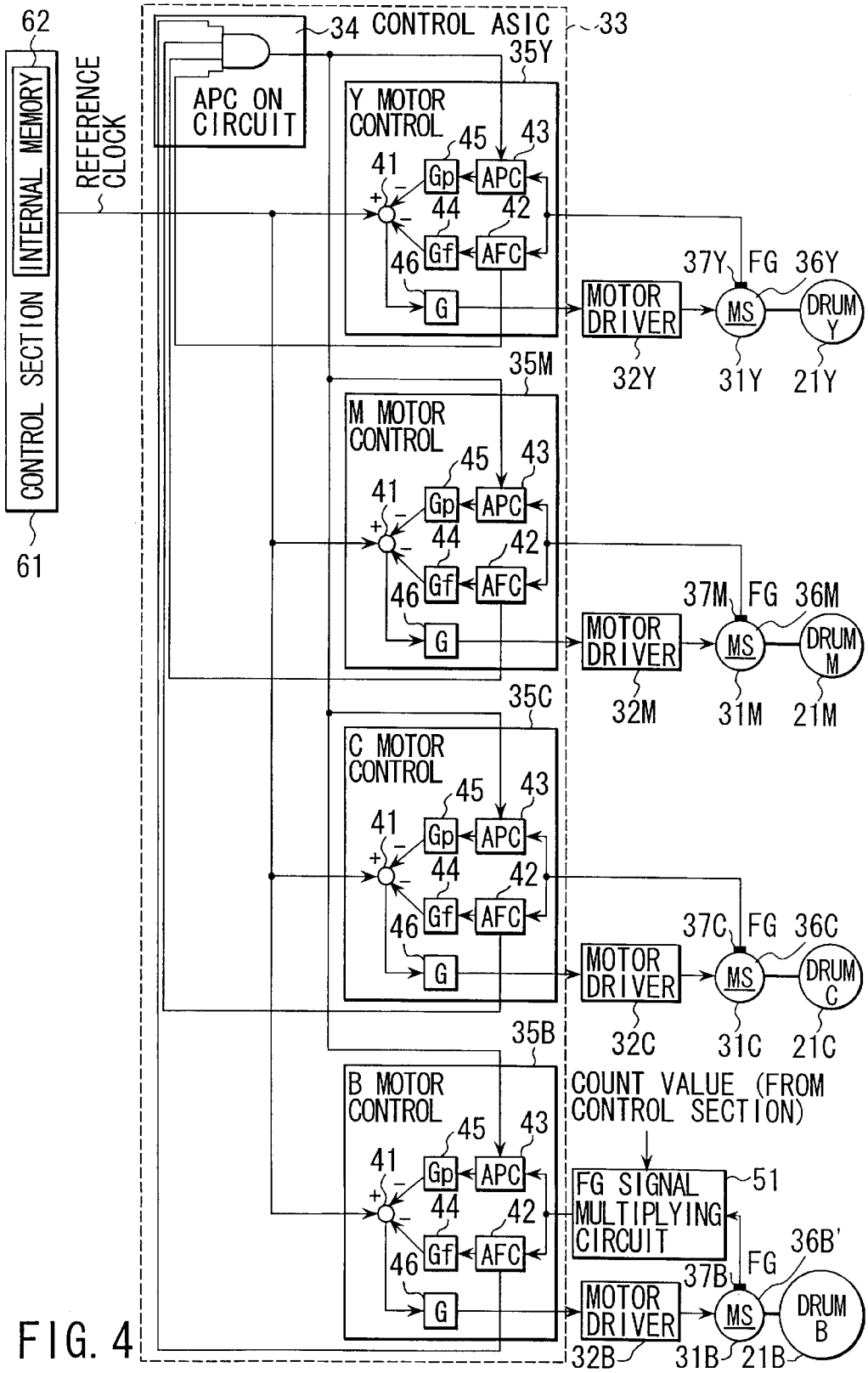
FIG. 4 is a diagram showing the schematic construction of a motor control section.

In this case. As shown in FIG. 4, an FG signal multiplying circuit 51 is provided between an FG pulse output section of the magnetic resistance element 37B and an FG pulse input section of the motor control circuit 35B. The FG signal multiplying circuit 51 multiplies or frequency-divides the FG pulse from the magnetic resistance element 37B according to the ratio of the diameter of the photosensitive drum 21B to the diameters of the other photosensitive drums 21Y, 21M, 21C.

An example of a multiplying circuit of ×2 (2/1) as the FG signal multiplying circuit 51 is explained with reference to FIGS. 5A to 5D. A timer clock uses a clock frequency lower than the reference clock from the control section 61 and, for example, it is set to 1/1024 of the reference clock.

That is, synchronization is attained by effecting the edge detection as shown in FIG. 5C with respect to an FG pulse from a magnet encoder 36B' as shown in FIG. 5B based on the timer clock from the control section 61 as shown in FIG. 5A.

First, the number of pulses of the timer clock in one pulse of the FG pulse is counted (count: N1).

Next, as shown in FIG. 5D, an FG pulse with the multiplication factor of 2/1 at an interval of the timer clock in which the count time is halved in a period of one pulse of the FG pulse is formed and output to the motor control circuit 35B. At the same time, the number of pulses of the timer clock for one pulse of the FG pulse is counted (count: N2).

Next, an FG pulse with the multiplication factor of 2/1 at an interval of the timer clock in which the count time is halved in a period of one pulse of the FG pulse as shown in FIG. 5D is formed and output to the motor control circuit 35B.

After this, by doing the same, the timing in a case where 2/1 is set in the FG signal multiplying circuit 51 is created.

Further, a case wherein the diameter of the photosensitive drum 21B is set to 4/3 times the diameters of the other photosensitive drums 21Y, 21M, 21C is explained.

An example of a multiplying circuit of ×2 (4/3) as the FG signal multiplying circuit 51 is explained with reference to FIGS. 6A to 6D. A timer clock uses a clock frequency lower than the reference clock from the control section 61 and, for example, it is set to 1/1024 of the reference clock.

Figures 6A, 6B, 6C, 6D:
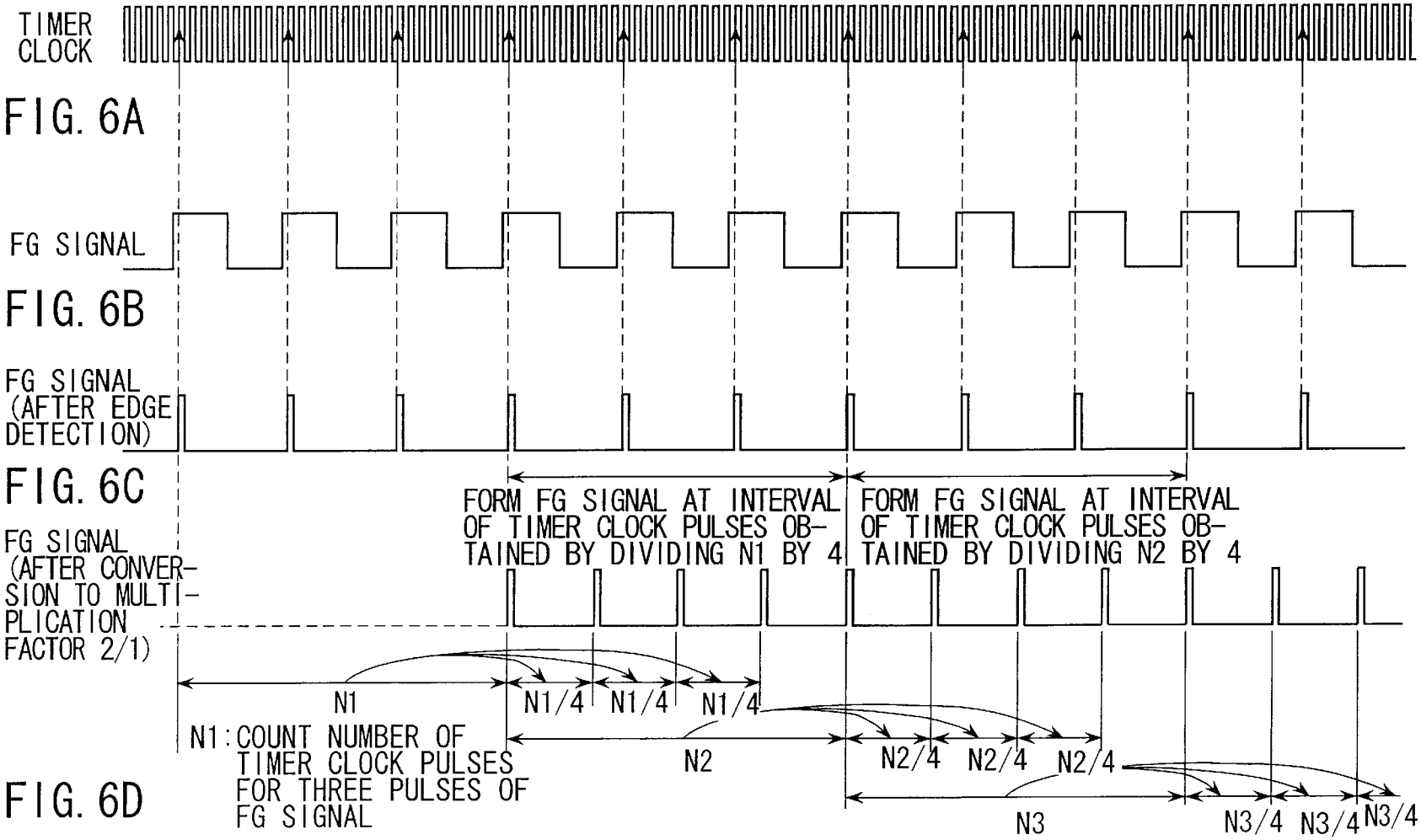
FIGS. 6A to 6D are timing charts for illustrating an FG signal multiplying circuit.

That is, synchronization is attained by effecting the edge detection as shown in FIG. 6C with respect to an FG pulse from the magnet encoder 36B' as shown in FIG. 6B based on the timer clock from the control section 61 as shown in FIG. 6A.

First, the number of pulses of the timer clock in three pulses of the FG pulse is counted (count: N1).

Next, an FG pulse with the multiplication factor of 4/3 at an interval of the timer clock in which the count time (N1) is divided by 4 in a period of three pulses of the FG pulse as shown in FIG. 6D is formed and output to the motor control circuit 35B.

Next, an FG pulse with the multiplication factor of 4/3 at an interval of the timer clock in which the count time (N2) is divided by 4 in a period of three pulses of the FG pulse as shown in FIG. 6D is formed and output to the motor control circuit 35B.

After this, by doing the same, the timing in a case where 4/3 is set in the FG signal multiplying circuit 51 is created.

Therefore, even when the diameter of the photosensitive drum 21B is larger than the diameters of the other photosensitive drums 21Y, 21M, 21C, the photosensitive drums 21Y, 21M, 21C, 21B can be rotated at the constant circumferential speed.

That is, it is possible to avoid the defect that the service lives of the photosensitive drums and transfer belt are shortened and image distortion occurs and the photosensitive drum 21B for black can be made larger than the diameters of the photosensitive drums 21Y, 21M, 21C for the other colors.

Third Embodiment

Next, as the third embodiment, the diameter of a photosensitive drum 21B is set larger than the diameters of other photosensitive drums 21Y, 21M, 21C, the FG pulses as the encoder pulses output from magnetic resistance elements 37Y, 37M, 37C, 37B of respective DC motors 31Y, 31M, 31C, 31B are the same and only the reference clock supplied to a motor control circuit 35B for controlling rotation of the DC motor 31B is multiplied or frequency-divided according to the ratio of the diameter of the photosensitive drum 21B to the diameters of the other photosensitive drums 21Y, 21M, 21C. The same portions as in the first embodiment are denoted by the same reference symbols and the explanation therefor is omitted.

Figure 7:
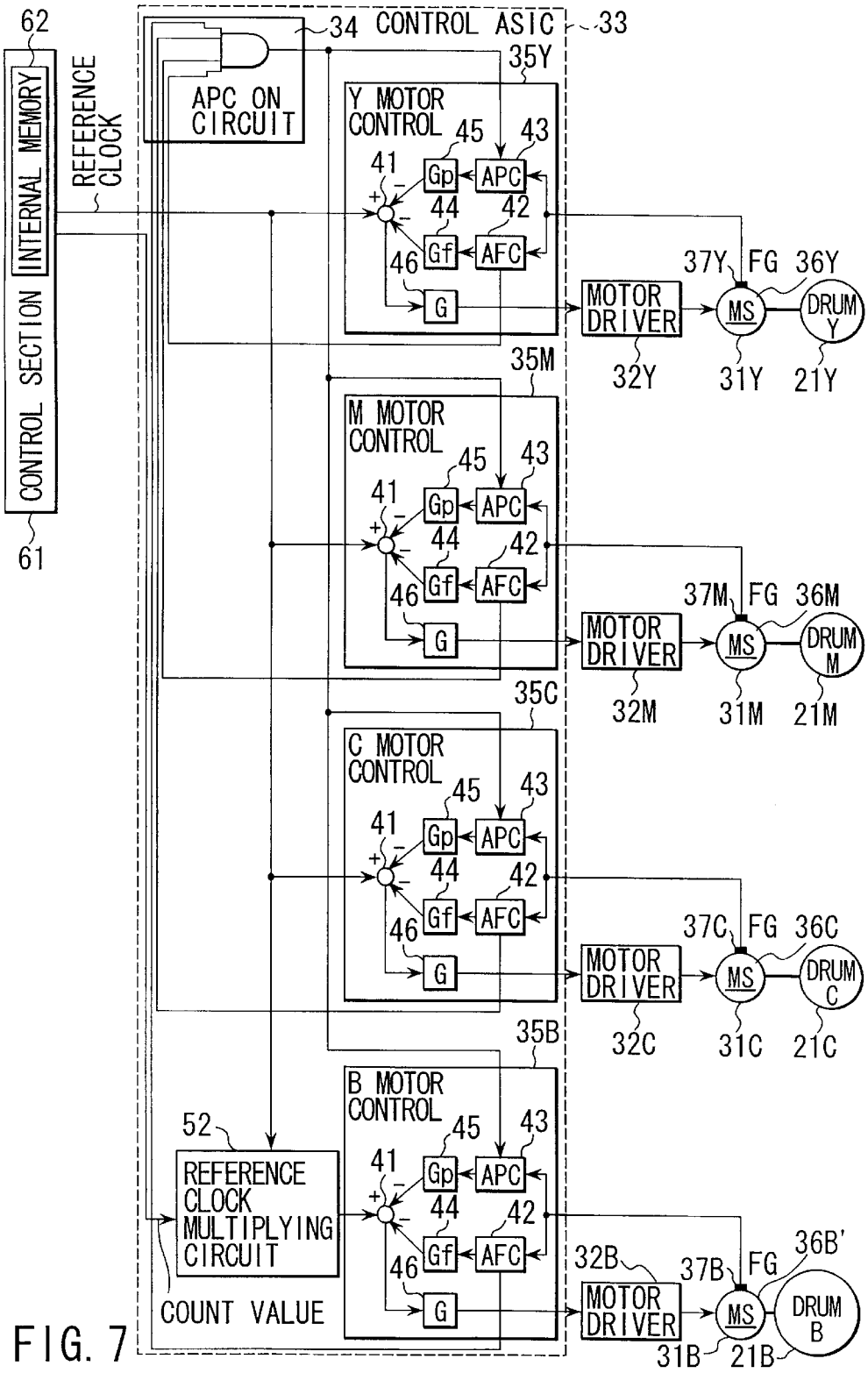
FIG. 7 is a diagram showing the schematic construction of a motor control section.

In this case, as shown in FIG. 7, FG pulses of 600 pulses are output from magnet encoders 36Y, 36M, 36C, 36B' while the corresponding photosensitive drums 21Y, 21M, 21C, 21B are making one revolution. Further, as shown in FIG. 7, a multiplying circuit or frequency dividing circuit as a reference clock multiplying circuit 52 is provided between a reference clock receiving section (not shown) from a control section 61 and the motor control circuit 35B.

The reference clock multiplying circuit 52 is a circuit for forming and outputting a clock obtained by multiplying or frequency-dividing the reference clock output from the control section 61 in accordance with an angular speed target setting value.

For example, in a case where the diameter of the photosensitive drum 21B is twice the diameters of the other photosensitive drums 21Y, 21M, 21C, the clock from the reference clock multiplying circuit 52 becomes half of the reference clock output from the control section 61.

As a result, the reference clock output from the control section 61 is supplied to the motor control circuits 35Y, 35M, 35C and the clock which is half the reference clock from the reference clock multiplying circuit 52 is supplied to the motor control circuit 35B.

Thus, the motor control circuits 35Y, 35M, 35C accelerate or decelerate the DC motors 31Y, 31M, 31C to set the frequency of the reference clock from the control section 61 equal to the frequencies of the FG pulses as the encoder pulses from the magnetic resistance elements 37Y, 37M, 37C and the motor control circuit 35B accelerates or decelerates the DC motor 31B to set the frequency of the clock which is half the reference clock from the reference clock multiplying circuit 52 equal to the frequency of the FG pulse as the encoder pulses from the magnetic resistance element 37B.

Therefore, the photosensitive drums 21Y, 21M, 21C, 21B can be rotated at the constant circumferential speed.

Figure 8:
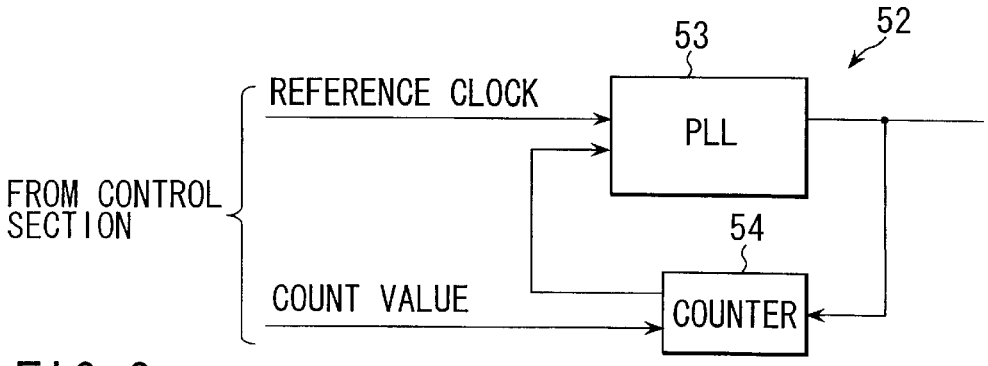
FIG. 8 is a diagram showing the schematic construction of a reference clock multiplying section.

As an example of the reference clock multiplying circuit 52, a frequency dividing circuit 52 as shown in FIG. 8 may be used. The frequency dividing circuit 52 is constructed by a PLL circuit 53 and counter 54 and the PLL circuit 53 is supplied with the reference clock from the control section 61 and a count-up output from the counter 54. A count value from the control section 61 is previously set in the counter 54, it counts the clock output from the PLL circuit 53 and when the set count value is reached, a count-up output is output.

The PLL circuit is a pre-scaler using a PLL and frequency-divides the reference clock in a good system. By setting "512" in the counter 54, the PLL circuit 53 frequency-divides the reference clock by 2 at the frequency dividing ratio of "512/1024".

Therefore, even when the diameter of the photosensitive drum 21B is larger than the diameters of the other photosensitive drums 21Y, 21M, 21C, the photosensitive drums 21Y, 21M, 21C, 21B can be rotated at the constant circumferential speed.

That is, it is possible to avoid the defect that the service lives of the photosensitive drums and transfer belt are shortened and image distortion occurs and the photosensitive drum 21B for black can be made larger than the diameters of the photosensitive drums 21Y, 21M, 21C for the other colors.

Fourth Embodiment

Next, as the fourth embodiment, something in which the construction is made with substantially the same diameters of photosensitive drums 21Y, 21M, 21C, 21B' and fine adjustment of rotation of the photosensitive drums 21Y, 21M, 21C, 21B' is made is explained. The same portions as in the first embodiment are denoted by the same reference symbols and the explanation therefor is omitted.

Figure 10:
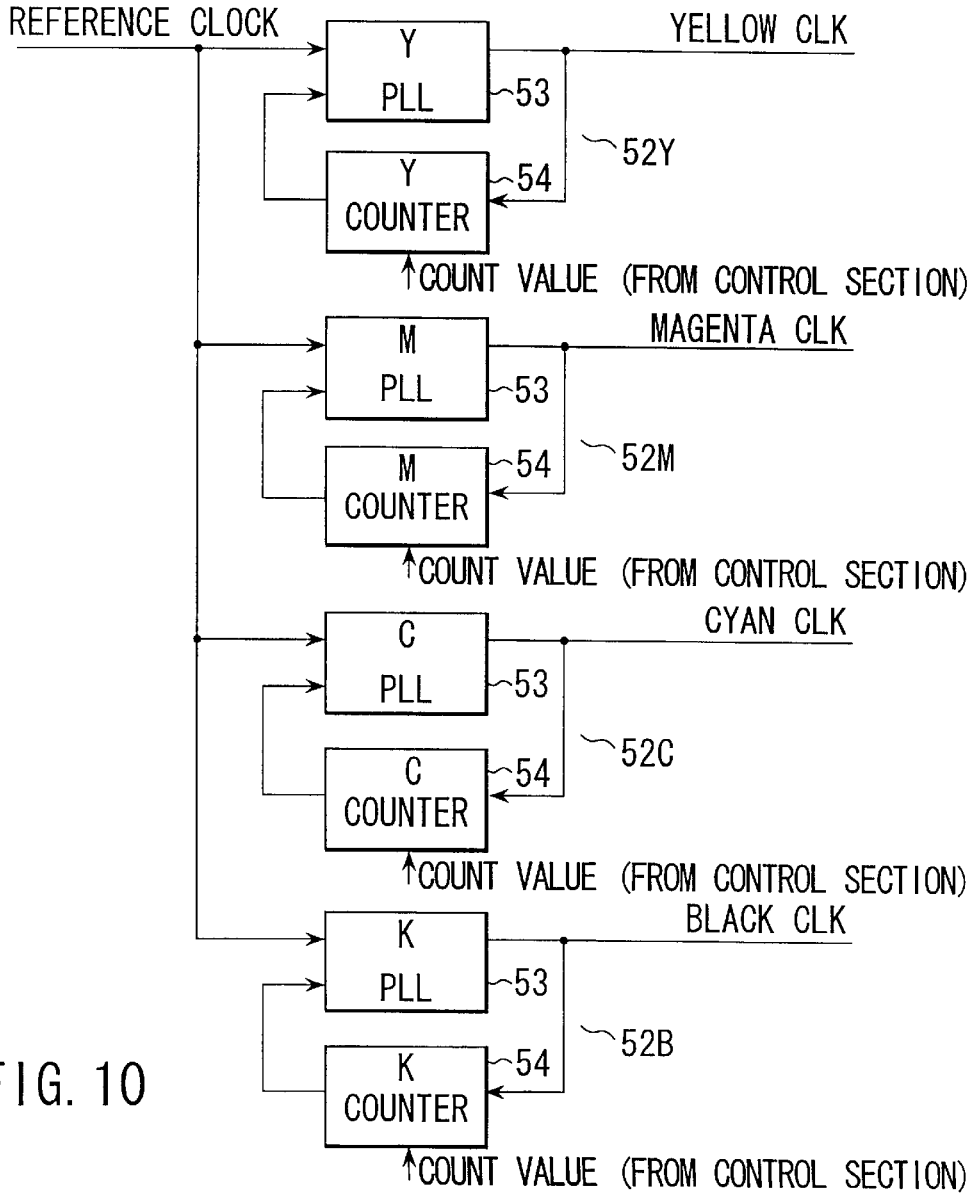
FIG. 10 is a diagram showing the schematic construction of a reference clock multiplying section.
Figure 9:
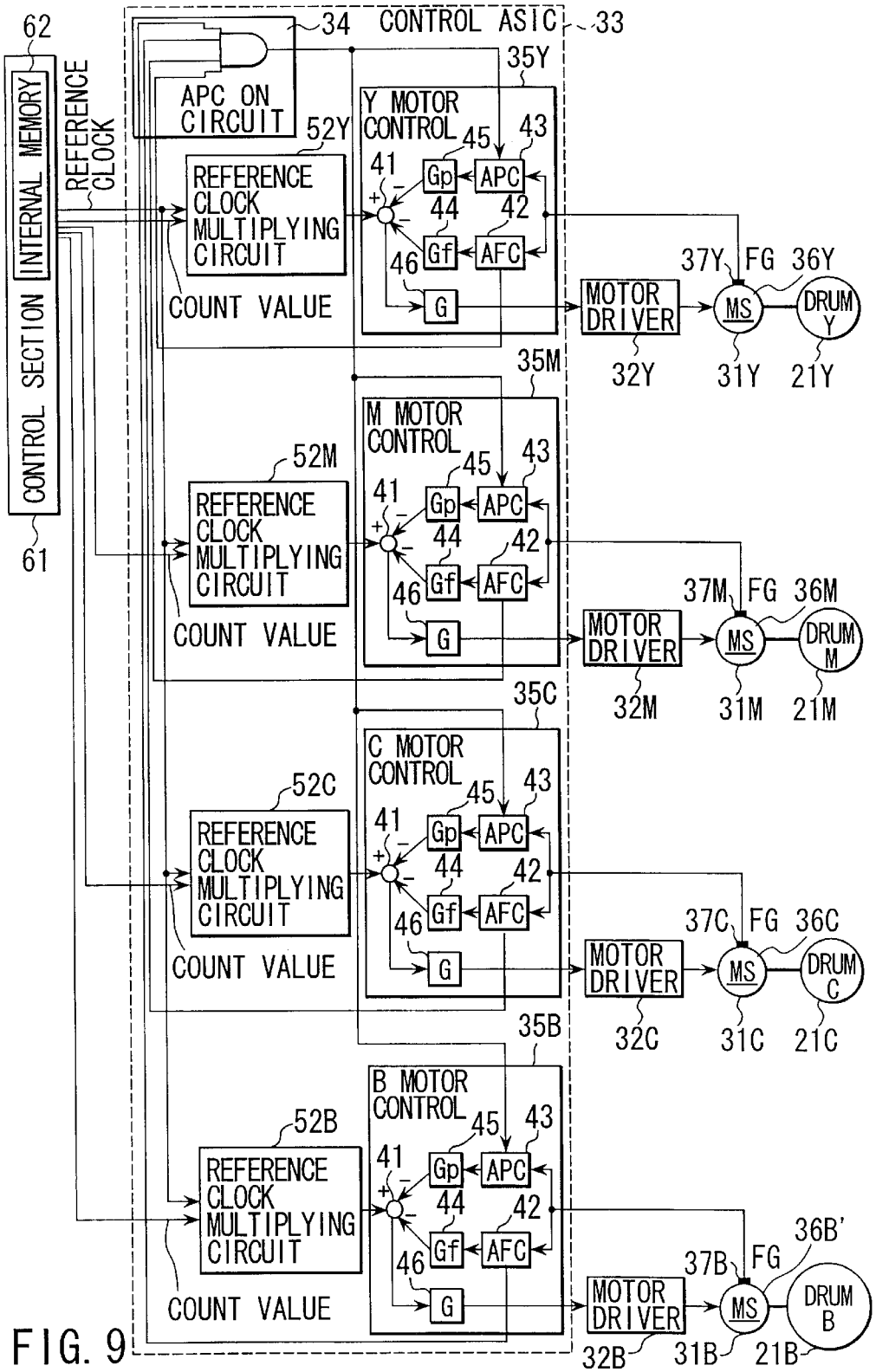
FIG. 9 is a diagram showing the schematic construction of a motor control section.

In this case, as shown in FIGS. 9, 10, FG pulses of 600 pulses are output from magnet encoders 36Y, 36M, 36C, 36B' while the corresponding photosensitive drums 21Y, 21M, 21C, 21B are making one revolution. Further, as shown in FIGS. 9, 10, frequency dividing circuits 52Y, 52M, 52C, 52B as the reference clock multiplying circuits 52Y, 52M, 52C, 52B used in the third embodiment are respectively provided between a reference clock input section of a control section 61 and motor control circuits 35Y, 35M, 35C, 35B.

For example, a case wherein fine adjustment is made with the DC motor 31Y used as a reference is explained.

As a result, by setting "1024" in a counter 54, a PLL circuit 53 outputs a reference clock through itself at the frequency dividing ratio of "1024/1024" in the frequency dividing circuit 52Y for the motor control circuit 35Y.

Further, by setting "949" in a counter 54, a PLL circuit 53 frequency-divides a reference clock at the frequency dividing ratio of "949/1024" and outputs the result in the frequency dividing circuit 52M for the motor control circuit 35M.

Further, by setting "10307" in a counter 54, a PLL circuit 53 frequency-divides a reference clock at the frequency dividing ratio of "1030/1024" and outputs the result in the frequency dividing circuit 52C for the motor control circuit 35C.

Further, by setting "1001" in a counter 54, a PLL circuit 53 frequency-divides a reference clock at the frequency dividing ratio of "1001/1024" and outputs the result in the frequency dividing circuit 52B for the motor control circuit 35B.

The values set in the counters 54, . . . are values previously set at the manufacturing time or the like and values registered in an internal memory 62 of the control section 61 are set in the respective counters 54, . . . at the power supply turn-ON time or the like.

Therefore, a small difference in the circumferential speed of the photosensitive drums 21Y, 21M, 21C, 21B' can be finely adjusted by changing the pulse of the reference clock and the photosensitive drums 21Y, 21M, 21C, 21B' can be rotated at the constant circumferential speed.

Fifth Embodiment

Next, as the fifth embodiment, something in which the diameter of a photosensitive drum 21B is set larger than the diameters of other photosensitive drums 21Y, 21M, 21C and rotation of each of the photosensitive drums 21Y, 21M, 21C, 21B is finely adjusted is explained. The same portions as in the first embodiment are denoted by the same reference symbols and the explanation therefor is omitted.

Figure 11:
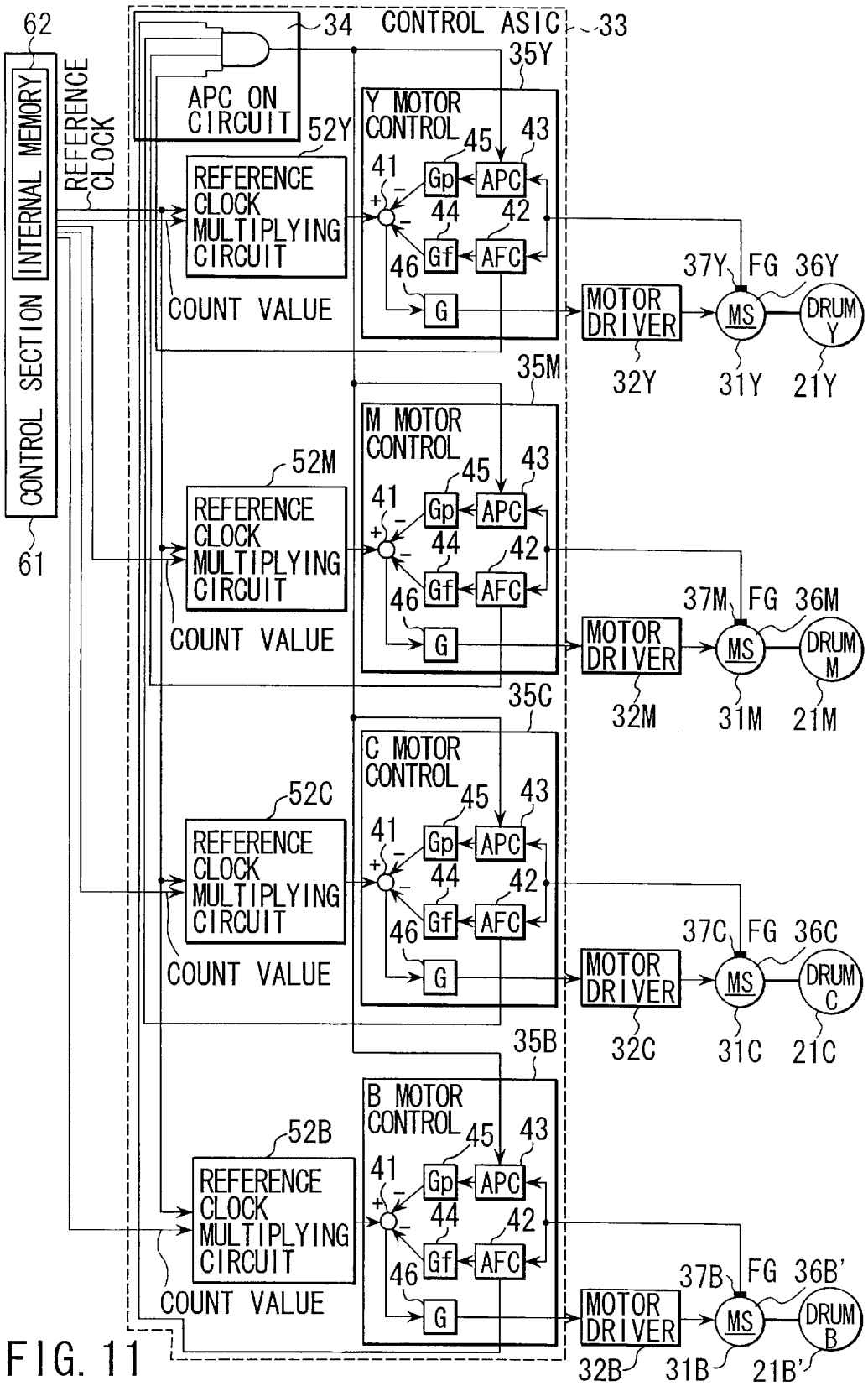
FIG. 11 is a diagram showing the schematic construction of a motor control section.

In this case, as shown in FIGS. 10, 11, FG pulses of 600 pulses are output from magnet encoders 36Y, 36M, 36C, 36B' while the corresponding photosensitive drums 21Y, 21M, 21C, 21B are making one revolution. Further, as shown in FIGS. 10, 11, frequency dividing circuits 52Y, 52M, 52C, 52B as the reference clock multiplying circuit 52 used in the third embodiment are provided between a reference clock input section of a control section 61 and motor control circuits 35Y, 35M, 35C, 35B.

For example, the explanation for a case wherein fine adjustment is made with a DC motor 31Y used as a reference.

As a result, by setting "1024" in a counter 54, a PLL circuit 53 outputs a reference clock through itself at the frequency dividing ratio of "1024/1024" in the frequency dividing circuit 52 for the motor control circuit 35Y.

Further, by setting "949" in a counter 54, a PLL circuit 53 frequency-divides a reference clock at the frequency dividing ratio of "949/1024" and outputs the result in the frequency dividing circuit 52 for the motor control circuit 35M.

Further, by setting "1030" in a counter 54, a PLL circuit 53 frequency-divides a reference clock at the frequency dividing ratio of "1030/1024" and outputs the result in the frequency dividing circuit 52 for the motor control circuit 35C.

Further, by setting "499" in a counter 54, a PLL circuit 53 frequency-divides a reference clock at the frequency dividing ratio of "499/1024" and outputs the result in the frequency dividing circuit 52 for the motor control circuit 35B.

The values set in the counters 54, . . . are values previously set at the manufacturing time or the like and values registered in an internal memory 62 of the control section 61 are set in the respective counters 54, . . . at the power supply turn-ON time or the like.

Therefore, even when the diameter of the photosensitive drum 21B is larger than the diameters of the other photosensitive drums 21Y, 21M, 21C, the photosensitive drums 21Y, 21M, 21C, 21B can be rotated at the constant circumferential speed.

Further, a small difference in the circumferential speed of the photosensitive drums 21Y, 21M, 21C, 21B can be finely adjusted by changing the pulses of the reference clock and the photosensitive drums 21Y, 21M, 21C, 21B can be rotated at the constant circumferential speed.

That is, it is possible to avoid the defect that the service lives of the photosensitive drums and transfer belt are shortened and image distortion occurs and the photosensitive drum 21B for black can be made larger than the diameters of the photosensitive drums 21Y, 21M, 21C for the other colors.

Sixth Embodiment

Next, as the sixth embodiment, something in which the diameter of a photosensitive drum 21B is larger than the diameters of other photosensitive drums 21Y, 21M, 21C and fine adjustment is made according to the rotational speeds of the photosensitive drums 21Y, 21M, 21C, 21B is explained. The same portions as in the first embodiment are denoted by the same reference symbols and the explanation therefor is omitted.

In this case, as in the second embodiment, FG pulses (the number of pulses for one revolution) as encoder pulses output from a magnetic resistance element 37B of a DC motor 31B are made different from FG pulses (the number of pulses for one revolution) as encoder pulses output from magnetic resistance elements 37Y, 37M, 37C of DC motors 31Y, 31M, 31C according to the ratio of the diameter of the photosensitive drum 21B to the diameters of the other photosensitive drums 21Y, 21M, 21C, and like the fourth embodiment, fine adjustment for rotation of the photosensitive drums 21Y, 21M, 21C, 21B is made.

Figure 12:
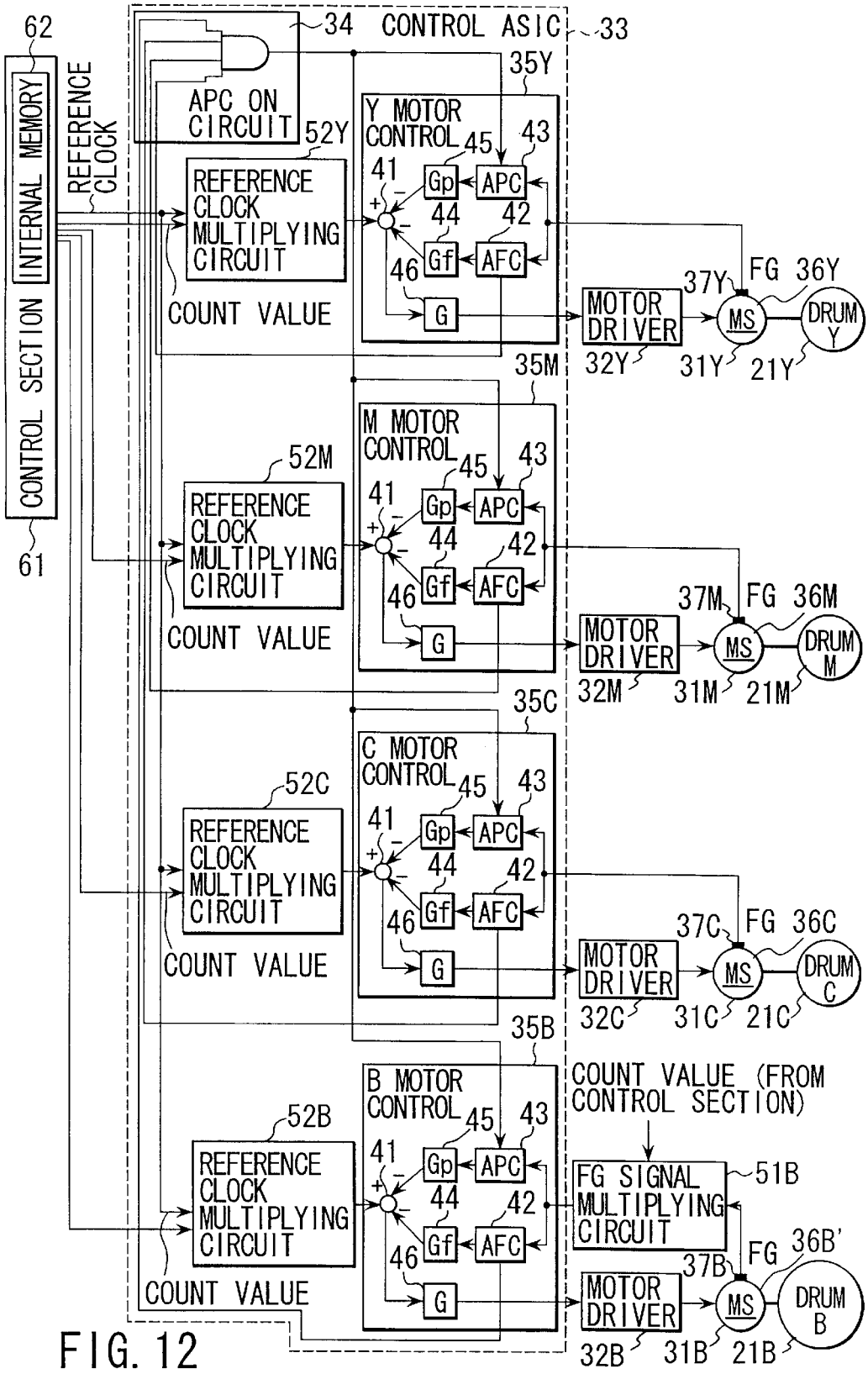
FIG. 12 is a diagram showing the schematic construction of a motor control section.

That is, as shown in FIG. 12, an FG signal multiplying circuit 51 (refer to the second embodiment) is provided between an output section of the magnetic resistance element 37B of the DC motor 31B and an FG pulse input section of a motor control circuit 35B and reference clock multiplying circuits 52Y, 52M, 52C, 52B (refer to the third, fourth embodiments) are respectively provided between an input section for a reference clock multiplication factor from the control section 61 and the motor control circuits 35Y, 35M, 35C, 35B.

Therefore, the photosensitive drums 21Y, 21M, 21C, 21B can be rotated at the constant circumferential speed even if the diameter of the photosensitive drum 21B is larger than the diameters of the other photosensitive drums 21Y, 21M, 21C.

Further, a small difference in the circumferential speed of the photosensitive drums 21Y, 21M, 21C, 21B can be finely adjusted by changing the pulses of the reference clock and the photosensitive drums 21Y, 21M, 21C, 21B can be rotated at the constant circumferential speed.

That is, it is possible to avoid the defect that the service lives of the photosensitive drums and transfer belt are shortened and image distortion occurs and the photosensitive drum 21B for black can be made larger than the diameters of the photosensitive drums 21Y, 21M, 21C for the other colors.

Seventh Embodiment

Next, as the seventh embodiment, set values of the counters 54 of the respective reference clock multiplying circuits 52Y, 52M, 52C, 52B when the fine adjustment in the fourth, fifth, sixth embodiments is made are explained. The set value is set based on the result of measurement of a difference in the circumferential speed of the photosensitive drums 21Y, 21M, 21C, 21B.

First, a control section 61 reads out the pattern of a registration mark registered in an internal memory 62 and electrostatic latent images corresponding to the above pattern are formed on the photosensitive drums 21Y, 21M, 21C, 21B by causing an exposure device 5 to be driven based on the pattern of the mark. The electrostatic latent images are developed by use of toner of corresponding colors and transferred to a transfer belt 6 or paper P on the transfer belt 6 by transfer devices 26Y, 26M, 26C, 26B.

Figure 13:
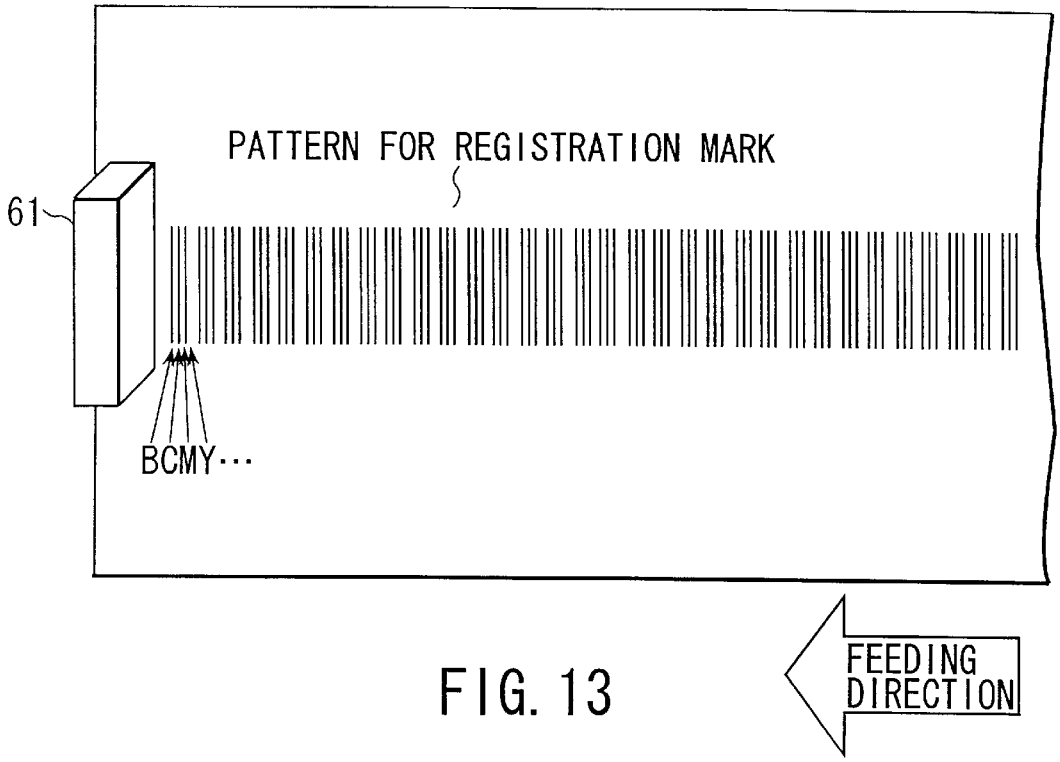
FIG. 13 is a diagram showing a pattern of a registration mark.

As the pattern of the registration mark, as shown in FIG. 13, a pattern of sets of respective colors of Y, M, C, B alternately arranged in a direction perpendicular to the moving direction of the transfer belt 6 is provided.

The pattern for the registration mark transferred on the transfer belt 6 or the paper P on the transfer belt 6 is detected by a sensor 27.

The sensor 27 is provided on the transfer belt 6 in the succeeding stage of an image forming section 4B.

The control section 61 measures the speeds for the respective colors, that is, the circumferential speeds of the respective photosensitive drums 21Y, 21M, 21C, 21B according to the interval of the line segments of the respective colors detected by the sensor 27.

Figure 14:
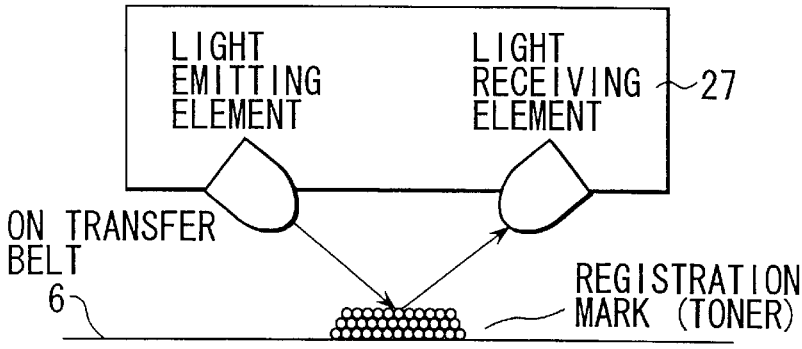
FIG. 14 is a diagram showing the schematic construction of a sensor.

As shown in FIG. 14, the sensor 27 is constructed by a reflection type sensor, detection of the respective colors is successively effected and the results of detection of the respective colors are registered in the internal memory 62 of the control section 61.

Eighth Embodiment

Next, as the eighth embodiment, something in which the construction is made with substantially the same diameters of photosensitive drums 21Y, 21M, 21C, 21B' and coarse fine adjustment caused to be necessary by rotational deviation and fine adjustment of a difference in the peripheral speed (circumferential speed) caused by a variation in the diameters of the photosensitive drums 21Y, 21M, 21C, 21B' can be made is explained. The same portions as in the first embodiment are denoted by the same reference symbols and the explanation therefor is omitted.

Figure 15:
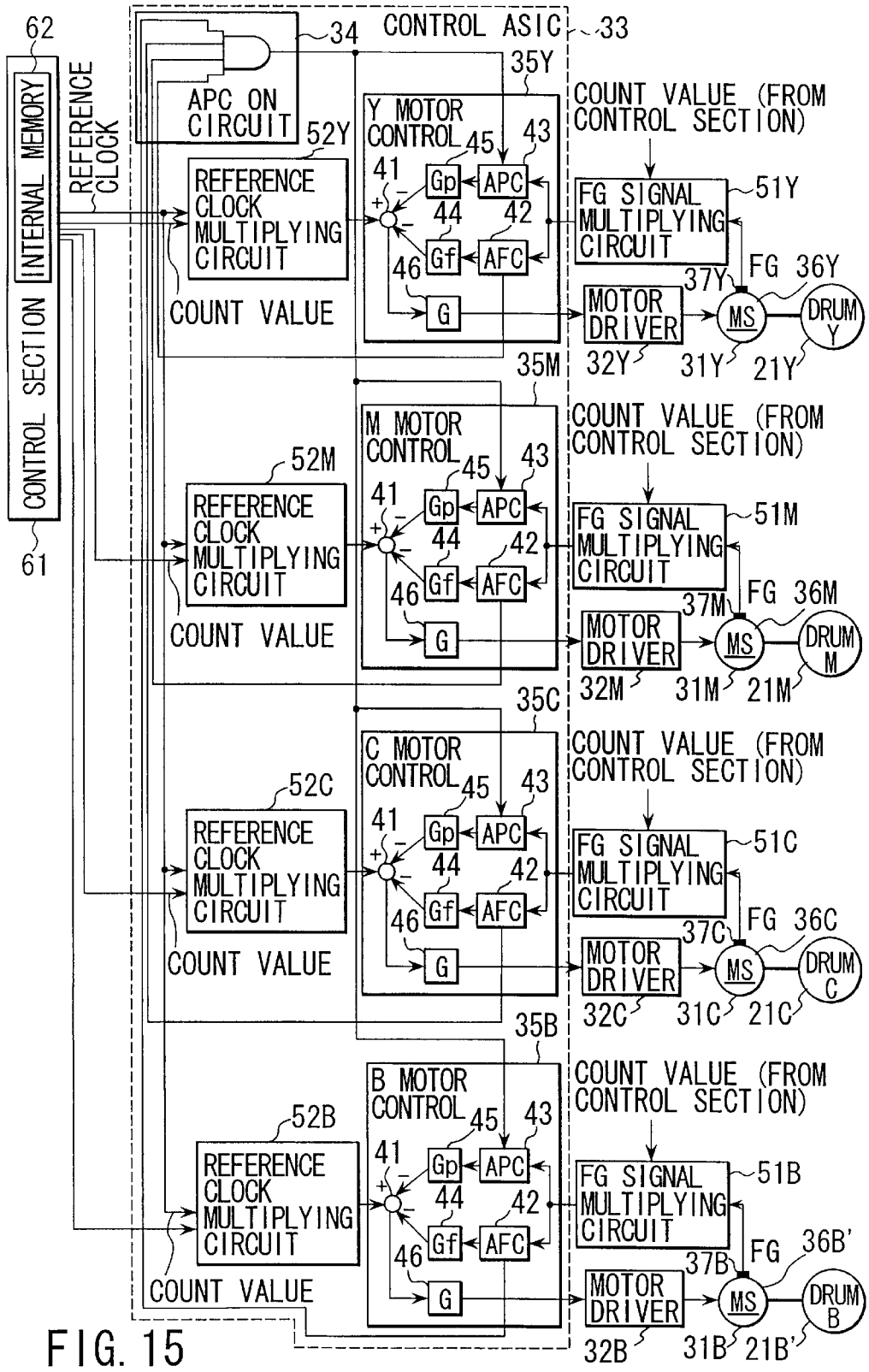
FIG. 15 is a diagram showing the schematic construction of a motor control section.

In this case, FG pulses of 600 pulses are output from magnet encoders 36Y, 36M, 36C, 36B' while the corresponding photosensitive drums 21Y, 21M, 21C, 21B' are making one revolution. Further, as shown in FIG. 15, FG signal multiplying circuits 51Y, 51M, 51C, 51B are provided between output sections of magnetic resistance elements 37Y, 37M, 37C, 37B of DC motors 31Y, 31M, 31C, 31B and FG pulse input sections of motor control circuits 35Y, 35M, 35C, 35B and reference clock multiplying circuits 52Y, 52M, 52C, 52B are respectively provided between a reference clock input section of a control section 61 and the motor control circuits 35Y, 35M, 35C, 35B. The rough adjustment is made by the FG signal multiplying circuits 51Y, 51M, 51C, 51B, that is, the adjustment caused to be necessary by deviation in the circumferential speeds of the photosensitive drums 21Y, 21M, 21C, 21B' is made and the fine adjustment is made by the reference clock multiplying circuits 52Y, 52M, 52C, 52B, that is, the fine adjustment for absorbing a variation in the peripheral speeds of the photosensitive drums 21Y, 21M, 21C, 21B' caused by a variation in the diameters of the photosensitive drums 21Y, 21M, 21C, 21B' is made.

The rough adjustment by the FG signal multiplying circuits 51 is made by making different FG pulses as encoder pulses output from the magnetic resistance elements 37Y, 37M, 37C, 37B of the DC motors 31Y, 31M, 31C, 31B according to deviation in the circumferential speeds of the photosensitive drums 21Y, 21M, 21C, 21B'.

Figure 16:
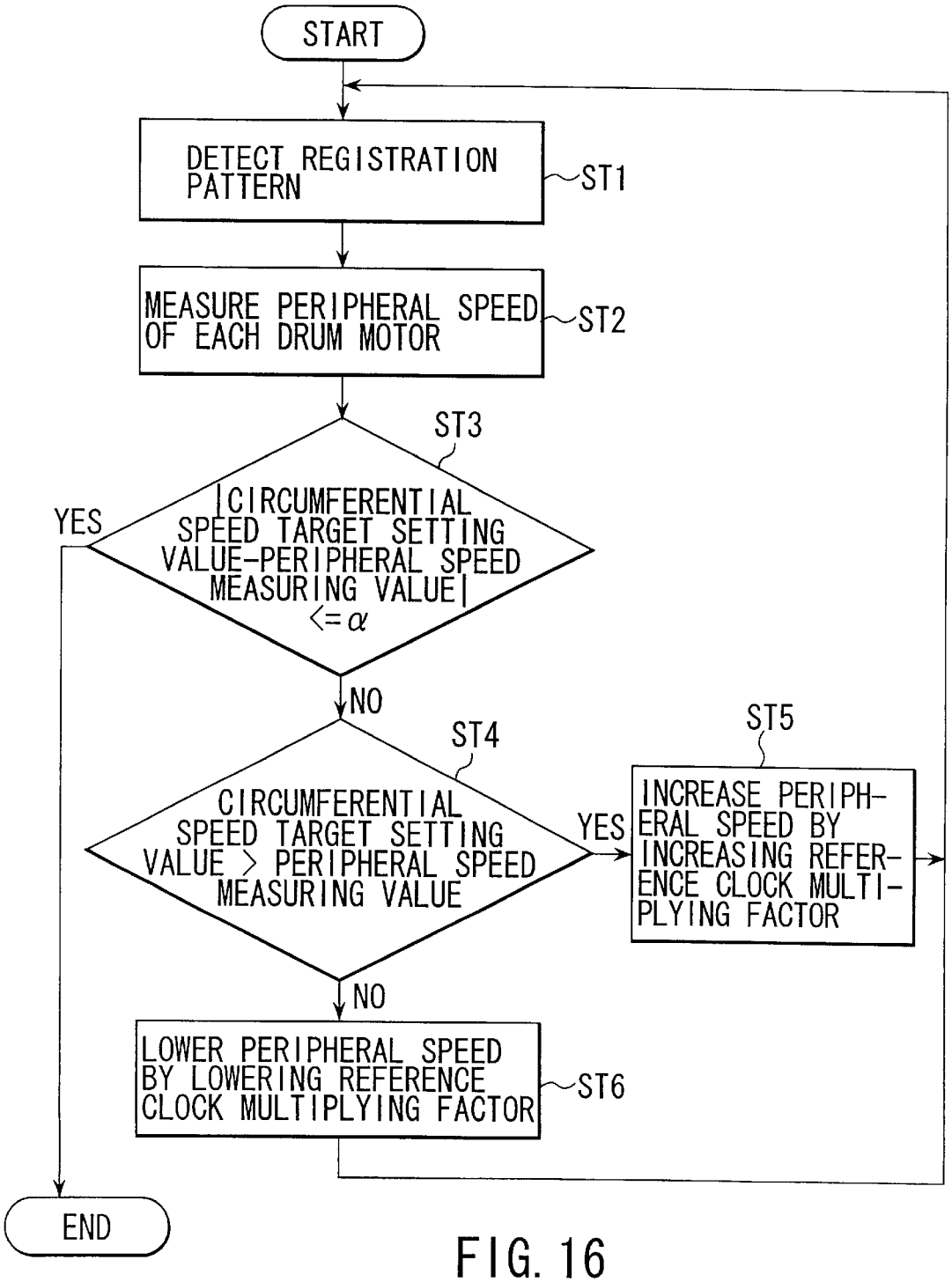
FIG. 16 is a flowchart for illustrating fine adjustment for absorbing a variation in the peripheral speed of a photosensitive drum accompanied by a variation in the diameter of the photosensitive drum.

The fine adjustment by the reference clock multiplying circuits 52Y, 52M, 52C, 52B, that is, the fine adjustment for absorbing a variation in the peripheral speeds of the photosensitive drums caused by a variation in the diameters of the photosensitive drums is explained below with reference to the flowchart shown in FIG. 16.

First, the control section 61 reads out the pattern of a registration mark registered in an internal memory 62 and electrostatic latent images corresponding to the pattern are formed on the photosensitive drums 21Y, 21M, 21C, 21B by causing an exposure device 5 to be driven based on the pattern of the mark. The electrostatic latent images are developed by use of toner of corresponding colors and transferred to a transfer belt 6 or paper P on the transfer belt 6 by transfer devices 26Y, 26M, 26C, 26B.

As the pattern of the registration mark, as shown in FIG. 13, a pattern of sets of respective colors of Y, M, C, B alternately arranged in a direction perpendicular to the moving direction of the transfer belt 6 is provided.

The pattern of the registration mark transferred on the transfer belt 6 or the paper P on the transfer belt 6 is detected by a sensor 27 (ST1).

The control section 61 measures the speeds for the respective colors, that is, the peripheral speeds of the respective photosensitive drums 21Y, 21M, 21C, 21B' according to the interval of the line segments of the respective colors detected by the sensor 27 (ST2).

The control section 61 determines whether a value obtained by subtracting the peripheral speed measurement value from the circumferential speed target setting value is within a preset range or not (ST3).

As the result of determination of the step 3, if the value obtained by subtracting the peripheral speed measurement value from the circumferential speed target setting value is outside the preset range, the control section 61 determines which one of the circumferential speed target setting value and the peripheral speed measurement value is larger (ST4).

As the result of determination of the step 4, if the circumferential speed target setting value is larger, the control section 61 increments the count value of the counter 54 of the reference clock multiplying circuit 52Y (52M, 52C, 52B) by one and increases the reference clock multiplying factor to raise the peripheral speed of the photosensitive drum (ST5).

As the result of determination of the step 4, if the peripheral speed measurement value is larger, the control section 61 decrements the count value of the counter 54 of the reference clock multiplying circuit 52Y (52M, 52C, 52B) by one and decreases the reference clock multiplying factor to lower the peripheral speed of the photosensitive drum (ST6).

As the result of determination of the step 3, if the value obtained by subtracting the peripheral speed measurement value from the circumferential speed target setting value is within the preset range, the control section 61 determines that the circumferential speed target setting value and the peripheral speed measurement value coincide with each other and if the pattern of the registration mark is further left behind, the step 1 is effected, and if the pattern of the registration mark is not left behind, the process is terminated.

The steps 3 to 6 are separately effected for the respective colors.

As a result, the control section 61 registers states (a changing pattern of the reference clock multiplying factor) for increasing or decreasing the reference clock multiplying factor by the steps 5, 6 for the respective colors in the internal memory 62 in the above process.

Thus, after this, fine adjustment is made based on the registered contents of the internal memory 62.

When the states for increasing or decreasing the reference clock multiplying factor by the steps 5, 6 for the respective colors are registered in the internal memory 62, the average of a plurality of measuring processes can be registered.

Therefore, in a case where the diameters of the photosensitive drums 21Y, 21M, 21C, 21B' are the same, a small difference in the circumferential speed is roughly adjusted by changing the encoder pulses, a difference in the peripheral speed (circumferential speed) caused by a difference in the diameters of the respective photosensitive drums 21Y, 21M, 21C, 21B' is finely adjusted by changing the pulses of the reference clock and the photosensitive drums 21Y, 21M, 21C, 21B' can be rotated at the constant circumferential speed.

Further, a difference in the peripheral speed (circumferential speed) caused by a difference in the diameters of the respective photosensitive drums 21Y, 21M, 21C, 21B', that is, a variation in the speed in which the peripheral speed becomes higher as the diameter is larger and the peripheral speed becomes lower as the diameter is smaller can be suppressed and it can be prevented that concentration irregularity occurs and a serious problem occurs in the image.

Figure 17A:
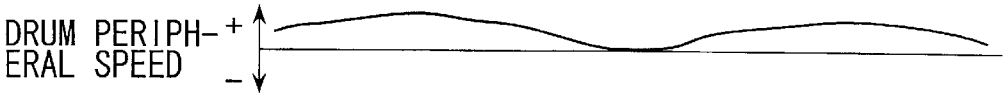
FIGS. 17A to 17C are diagrams for explaining concentration irregularity due to a difference in the peripheral speed of the photosensitive drum accompanied.
Figure 17B:
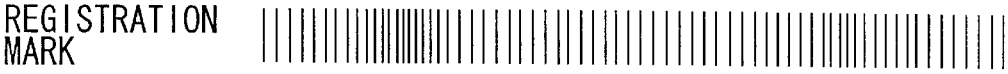
Figure 17C:
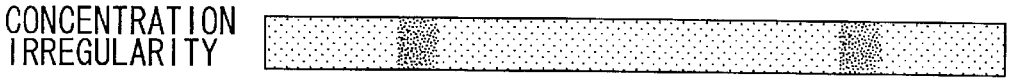
Figure 18A:
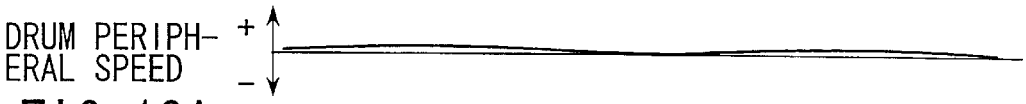
FIGS. 18A to 18C are diagrams showing a case wherein a difference in the peripheral speed of the photosensitive drum accompanied is made small and the concentration irregularity is omitted.
Figure 18B:
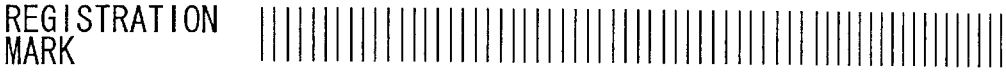
Figure 18C:
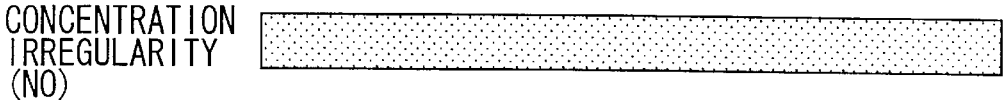

Concentration irregularity which conventionally occurs due to a difference in the peripheral speed of the photosensitive drums caused by a variation in the diameters with respect to the pattern of the registration mark as shown in FIGS. 17A to 17C can be eliminated by suppressing the difference in the peripheral speed of the photosensitive drums caused by the variation in the diameters with respect to the pattern of the registration mark as shown in FIGS. 18A to 18C.

What is claimed is:

1. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having a larger diameter than said first image carrying body, provided along said feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on a rotating shaft of said second rotating section;

converting means for converting an encode pulse from said second output section to a multiplied or frequency-divided pulse based on a difference between the diameters of said first, second image carrying bodies;

alteration means for multiplying or dividing the encode pulse from the second output section by a value obtained by dividing the diameter of the second image carrying body with the diameter of the first image carrying body;

a first control section for controlling rotation of said first rotating section at the rate of rotation based on the encode pulse from said first output section;

a second control section for controlling said second rotating section at the rate of rotation based on a pulse determined by the alteration means; and a fixing section provided along said feeding section in a succeeding stage of said second image forming unit, for fixing the toner image transferred on the recording medium; and characterized in that said first and second rotating sections are independent of each other, and the circumferential thereof are controlled to be constant.

2. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having a larger diameter than said first image carrying body, provided along said feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on a rotating shaft of said second rotating section;

a third output section for outputting a reference clock for rotating said first, second rotating sections at the preset rates of rotation;

converting means for converting the reference clock from said third output section to a multiplied or frequency-divided pulse based on a difference between the diameters of said first and second image carrying bodies;

a first control section for controlling rotation of said first rotating section at the rate of rotation based on the encode pulse from said first output section and the reference clock from said third output section;

a second control section for controlling rotation of said second rotating section at the rate of rotation based on the encode pulse from said second output section and the pulse from said converting means; and a fixing section provided along said feeding section in a succeeding stage of said second image forming unit, for fixing the toner image transferred on the recording medium; and characterized in that the circumferential speeds of said first, second image carrying bodies are made equal to each other.

3. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having the same diameter as said first image carrying body, provided along said feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on said rotating shaft of said second rotating section;

a third output section for outputting a reference clock for rotating said first, second rotating sections at the preset rates of rotation;

converting means for converting the reference clock from said third output section to a multiplied or frequency-divided pulse based on a difference between the circumferential speed of said first image carrying body and the circumferential speed of said second image carrying body;

a first control section for controlling rotation of said first rotating section at the rate of rotation based on the encode pulse from said first output section and the reference clock from said third output section;

a second control section for controlling rotation of said second rotating section at the rate of rotation based on the encode pulse from said second output section and the pulse from said converting means; and a fixing section provided along said feeding section in a succeeding stage of said second image forming unit, for fixing the toner image transferred on the recording medium; and characterized in that the circumferential speeds of said first, second image carrying bodies are made equal to each other.

4. The image forming apparatus according to claim 3, characterized by:

generating means for generating a pattern of a registration mark for each of the first, second colors;

first forming means for forming a toner image of the pattern of the registration mark of the first color generated by said generating means on said feeding section by said first image forming unit;

second forming means for forming a toner image of the pattern of the registration mark of the second color generated by said generating means on said feeding section by said second image forming unit;

a detector provided along said feeding section in a succeeding stage of said second image forming unit, for detecting the toner image of the pattern of the registration mark of each of the first, second colors formed on said feeding section; and measuring means for measuring the circumferential speed of said first image carrying body based on the pattern of the registration mark of the first color detected by said detector and measuring the circumferential speed of said second image carrying body based on the pattern of the registration mark of the second color detected by said detector; and characterized in that conversion by said converting means is made according to the circumferential speed of said first image carrying body and the circumferential speed of said second image carrying body measured by said measuring means.

5. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having a diameter larger than said first image carrying body, provided along said feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on a rotating shaft of said second rotating section;

a third output section for outputting a reference clock for rotating said first, second rotating sections at the preset rates of rotation;

converting means for converting the reference clock from said third output section to a multiplied or frequency-divided pulse based on a difference between the circumferential speed of said first image carrying body and the circumferential speed of said second image carrying body;

a first control section for controlling rotation of said first rotating section at the rate of rotation based on the encode pulse from said first output section and the reference clock from said third output section;

a second control section for controlling rotation of said second rotating section at the rate of rotation based on the encode pulse from said second output section and the pulse from said converting means; and a fixing section provided along said feeding section in a succeeding stage of said second image forming unit, for fixing the toner image transferred on the recording medium; and characterized in that the circumferential speeds of said first, second image carrying bodies are made equal to each other.

6. The image forming apparatus according to claim 5, characterized by:

generating means for generating a pattern of a registration mark for each of the first, second colors;

first forming means for forming a toner image of the pattern of the registration mark of the first color generated by said generating means on said feeding section by said first image forming unit;

second forming means for forming a toner image of the pattern of the registration mark of the second color generated by said generating means on said feeding section by said second image forming unit;

a detector provided along said feeding section in a succeeding stage of said second image forming unit, for detecting the toner image of the pattern of the registration mark of each of the first, second colors formed on said feeding section; and measuring means for measuring the circumferential speed of said first image carrying body based on the pattern of the registration mark of the first color detected by said detector and measuring the circumferential speed of said second image carrying body based on the pattern of the registration mark of the second color detected by said detector; and characterized in that conversion by said converting means is made according to the circumferential speed of said first image carrying body and the circumferential speed of said second image carrying body measured by said measuring means.

7. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having a diameter larger than said first image carrying body, provided along said feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on a rotating shaft of said second rotating section;

first converting means for converting the encode pulse from said second output section to a multiplied or frequency-divided pulse based on a difference between the circumferential speeds of said first, second image carrying bodies;

a third output section for outputting a reference clock for rotating said first, second rotating sections at the preset rates of rotation;

second converting means for converting the reference clock from said third output section to a multiplied or frequency-divided pulse based on a difference between the circumferential speed of said first image carrying body and the circumferential speed of said second image carrying body;

a first control section for controlling rotation of said first rotating section at the rate of rotation based on the encode pulse from said first output section and the reference clock from said third output section;

a second control section for controlling rotation of said second rotating section at the rate of rotation based on the pulse from said first converting means and the pulse from said second converting means; and a fixing section provided along said feeding section in a succeeding stage of said second image forming unit, for fixing the toner image transferred on the recording medium; and characterized in that the circumferential speeds of said first, second image carrying bodies are made equal to each other.

8. The image forming apparatus according to claim 7, characterized by:

generating means for generating a pattern of a registration mark for each of the first, second colors;

first forming means for forming a toner image of the pattern of the registration mark of the first color generated by said generating means on said feeding section by said first image forming unit;

second forming means for forming a toner image of the pattern of the registration mark of the second color generated by said generating means on said feeding section by said second image forming unit;

a detector provided along said feeding section in a succeeding stage of said second image forming unit, for detecting the toner image of the pattern of the registration mark of each of the first, second colors formed on said feeding section; and measuring means for measuring the circumferential speed of said first image carrying body based on the pattern of the registration mark of the first color detected by said detector and measuring the circumferential speed of said second image carrying body based on the pattern of the registration mark of the second color detected by said detector; and characterized in that conversion by said converting means is made according to the circumferential speed of said first image carrying body and the circumferential speed of said second image carrying body measured by said measuring means.

9. An image forming apparatus comprising:

a feeding section for feeding a recording medium;

a first image forming unit respectively including a first image carrying body provided along said feeding section and arranged in contact with said feeding section, a first latent image forming section for forming a latent image on said first image carrying body, a first developing section for supplying toner of first color to the latent image formed on said first image carrying body by said first latent image forming section to develop the same, and a first transfer section for transferring the toner image developed by said first developing section on the recording medium fed by said feeding section;

a second image forming unit respectively including a second image carrying body having the same diameter as said first image carrying body, provided along the feeding section in a succeeding stage of said first image forming unit and arranged in contact with said feeding section, a second latent image forming section for forming a latent image on said second image carrying body, a second developing section for supplying toner of second color to the latent image formed on said second image carrying body by said second latent image forming section to develop the same, and a second transfer section for transferring the toner image developed by said second developing section on the recording medium fed by said feeding section;

a first rotating section for rotating said first image carrying body;

a second rotating section for rotating said second image carrying body;

a first output section for outputting an encode pulse with a preset number of pulses for one revolution based on a first encoder provided on a rotating shaft of said first rotating section;

a second output section for outputting an encode pulse with a preset number of pulses for one revolution based on a second encoder provided on a rotating shaft of said second rotating section;

first converting means for converting the encode pulse from said second output section to a multiplied or frequency-divided pulse based on a difference between the circumferential speed of said first image carrying body and the circumferential speed of said second image carrying body;

a third output section for outputting a reference clock for rotating said first, second rotating sections at the preset rates of rotation;

second converting means for converting the reference clock from said third output section to a multiplied or frequency-divided pulse based on a variation in the circumferential speed of said first image carrying body;

third converting means for converting the reference clock from said third output section to a multiplied or frequency-divided pulse based on a variation in the circumferential speed of said second image carrying body;

a first control section for controlling rotation of said first rotating section at the rate of rotation based on the encode pulse from said first output section and the pulse from said second converting means;

a second control section for controlling rotation of said second rotating section at the rate of rotation based on the pulse from said first converting means and the pulse from said third converting means; and a fixing section provided along said feeding section in a succeeding stage of said second image forming unit, for fixing the toner image transferred on the recording medium; and characterized in that the circumferential speeds of said first, second image carrying bodies are made equal to each other.

10. The image forming apparatus according to claim 9, characterized by:

generating means for generating a pattern of a registration mark for each of the first, second colors;

first forming means for forming a toner image of the pattern of the registration mark of the first color generated by said generating means on said feeding section by said first image forming unit;

second forming means for forming a toner image of the pattern of the registration mark of the second color generated by said generating means on said feeding section by said second image forming unit;

a detector provided along said feeding section in a succeeding stage of said second image forming unit, for detecting the toner image of the pattern of the registration mark of each of the first, second colors formed on said feeding section; and measuring means for measuring the circumferential speed of said first image carrying body based on the pattern of the registration mark of the first color detected by said detector and measuring the circumferential speed of said second image carrying body based on the pattern of the registration mark of the second color detected by said detector; and characterized in that conversion by said converting means is made according to the circumferential speed of said first image carrying body and the circumferential speed of said second image carrying body measured by said measuring means.

* * * * *